US007828708B2

(12) United States Patent
Huang et al.

(10) Patent No.: US 7,828,708 B2
(45) Date of Patent: Nov. 9, 2010

(54) CASE ERECTOR AND SEALER APPARATUS

(75) Inventors: Jindai Huang, Surrey (CA); Alex Ching Hung Lau, Vancouver (CA); Jeremy Zoss, San Antonio, TX (US); Paul Avery, San Antonio, TX (US)

(73) Assignee: Wexxar Packaging, Inc., Delta, British Columbia (CA)

( * ) Notice: Subject to any disclaimer, the term of this patent is extended or adjusted under 35 U.S.C. 154(b) by 116 days.

(21) Appl. No.: 12/244,929

(22) Filed: Oct. 3, 2008

(65) Prior Publication Data

US 2009/0093355 A1 Apr. 9, 2009

Related U.S. Application Data

(60) Provisional application No. 60/977,401, filed on Oct. 4, 2007.

(51) Int. Cl.
*B31B 1/48* (2006.01)

(52) U.S. Cl. ..... 493/80; 493/65; 493/70; 493/124; 493/315

(58) Field of Classification Search ..... 53/458, 53/136.3, 136.4, 381.1, 565, 566; 493/65, 493/68, 70–73, 79–81, 124, 128, 130, 315–317
See application file for complete search history.

(56) References Cited

U.S. PATENT DOCUMENTS 3,564,980 A * 2/1971 Winters ..... 493/317
3,747,482 A * 7/1973 Berney ..... 493/181
4,213,285 A 7/1980 Mancini
4,498,893 A 2/1985 Odom
4,553,954 A 11/1985 Sewell et al.
4,857,038 A * 8/1989 Tacchini ..... 493/316
4,915,678 A 4/1990 Morita
5,440,852 A 8/1995 Lam
5,480,371 A 1/1996 Morita et al.
5,772,568 A 6/1998 Chen
6,080,095 A 6/2000 Chen
6,319,183 B1 11/2001 Ballos, III
6,915,622 B2 * 7/2005 Spatafora ..... 53/458
6,929,593 B1 8/2005 Chen
6,971,980 B2 12/2005 Chiu Chen
7,131,941 B2 11/2006 Makar et al.
7,192,393 B2 3/2007 Makar et al.

(Continued)

*Primary Examiner*—Hemant M Desai
(74) *Attorney, Agent, or Firm*—Thompson Hine LLP

(57) ABSTRACT

An automated case erecting apparatus for use in erecting case blanks includes a case blank feeder configured to hold a plurality of upstanding case blanks arranged face-to-face. The case blank feeder includes a path along which the case blanks are directed. A case erecting assembly receives a case blank from the case blank feeder at a case receiving location. The case erecting assembly includes a first arm carrying a first gripper element and a second arm carrying a second gripper element. The first arm and associated first gripper element are arranged and configured such that the first gripper element grips a first flap of the case blank. The second arm and associated second gripper element are arranged and configured such that the second gripper element grips a second flap of the case blank. The case erecting assembly is configured to move in a conveying direction from the case receiving location toward a case bottom fold and seal station to carry the gripped case blank toward the case bottom fold and seal station.

18 Claims, 35 Drawing Sheets

U.S. PATENT DOCUMENTS 7,311,650 B2 * 12/2007 Makar et al. ..... 493/309
7,510,517 B2 * 3/2009 Goodman ..... 493/313
2006/0096712 A1 5/2006 Makar et al.
2007/0128898 A1 6/2007 Makar et al.

* cited by examiner

CASE ERECTOR AND SEALER APPARATUS

CROSS-REFERENCE TO RELATED APPLICATIONS

This application claims priority to U.S. Provisional Patent Application No. 60/977,401, filed Oct. 4, 2007, the details of which are incorporated by reference as if fully set forth herein.

TECHNICAL FIELD

The present application relates to case erector and sealer apparatus and more particularly to a case erector and sealer apparatus including a case spread-out system and case sealing device.

BACKGROUND

Case sealing apparatus are known for taping or gluing flaps of a case closed. As used herein, the term "case" is meant to include cartons, boxes, etc. U.S. Pat. No. 4,553,954, as an example, describes an automatic case erector and sealer apparatus useful in the erecting of case blanks using case puncturing and gripping pins.

SUMMARY

In an aspect, an automated case erecting apparatus for use in erecting case blanks includes a case blank feeder configured to hold a plurality of upstanding case blanks arranged face-to-face. The case blank feeder includes a path along which the case blanks are directed. A case erecting assembly receives a case blank from the case blank feeder at a case receiving location. The case erecting assembly includes a first arm carrying a first gripper element and a second arm carrying a second gripper element. The first arm and associated first gripper element are arranged and configured such that the first gripper element grips a first flap of the case blank. The second arm and associated second gripper element are arranged and configured such that the second gripper element grips a second flap of the case blank. The case erecting assembly is configured to move in a conveying direction from the case receiving location toward a case bottom fold and seal station to carry the gripped case blank toward the case bottom fold and seal station.

In another aspect, an automated case erecting apparatus for use in erecting case blanks includes a case blank feeder configured to hold a plurality of upstanding case blanks arranged face-to-face. The case blank feeder includes a path along which the case blanks are directed. A case erecting assembly receives a case blank from the case blank feeder at a case receiving location. The case erecting assembly includes a first arm carrying a first gripper element and a second arm carrying a second gripper element. The first arm and associated first gripper element are arranged and configured such that the first gripper element grips a first case flap of the case blank. The second arm and associated second gripper element are arranged and configured such that the second gripper element grips a second case flap of the case blank. The second case flap is opposite the first case flap. The case erecting assembly is configured to erect the case blank by pivoting both the first arm and the second arm from respective case receiving orientations to respective case erecting orientations.

In another aspect, an automated case erecting apparatus for use in erecting case blanks includes a case blank feeder configured to hold a plurality of upstanding case blanks arranged face-to-face. The case blank feeder includes a path along which the case blanks are directed. A case erecting assembly receives a case blank from the case blank feeder at a case receiving location. The case erecting assembly includes a first arm carrying a first gripper element and a second arm carrying a second gripper element. The first arm and associated first gripper element are arranged and configured such that the first gripper element grips a first bottom case flap of the case blank. The second arm and associated second gripper element are arranged and configured such that the second gripper element grips a second bottom case flap of the case blank. At least one of the first arm and the second arm moves to erect the case.

In another aspect, an automated case erecting apparatus for use in erecting case blanks includes a case blank feeder configured to hold a plurality of upstanding case blanks arranged face-to-face. The case blank feeder includes a path along which the case blanks are directed. A case erecting assembly receives a case blank from the case blank feeder at a case receiving location. The case erecting assembly includes a first arm including a first plurality of pin and dome assemblies mounted thereon and a second arm including a second plurality of pin and dome assemblies mounted thereon. A multiplicity of the pin and dome assemblies of the first arm are mounted for movement and selective positioning along a lengthwise slot of the first arm. A multiplicity of the pin and dome assemblies of the second arm are mounted for movement and selective positioning along a lengthwise slot of the second arm.

In yet another aspect, an automated case erecting apparatus for use in erecting case blanks includes a case blank feeder configured to hold a plurality of upstanding case blanks arranged face-to-face. The case blank feeder includes a path along which the case blanks are directed. A case erecting assembly receives a case blank from the case blank feeder at a case receiving location. The case erecting assembly includes a first arm including a first case flap gripper element carried by the first arm and a second arm including a second case flap gripper element carried by the second arm. The case erecting assembly is selectively configurable in a first orientation to handle right hand open style cases and in a second orientation to handle left hand open style cases.

The details of one or more embodiments are set forth in the accompanying drawings and the description below. Other features, objects, and advantages will be apparent from the description and drawings, and from the claims.

DETAILED DESCRIPTION

Figure 1A:
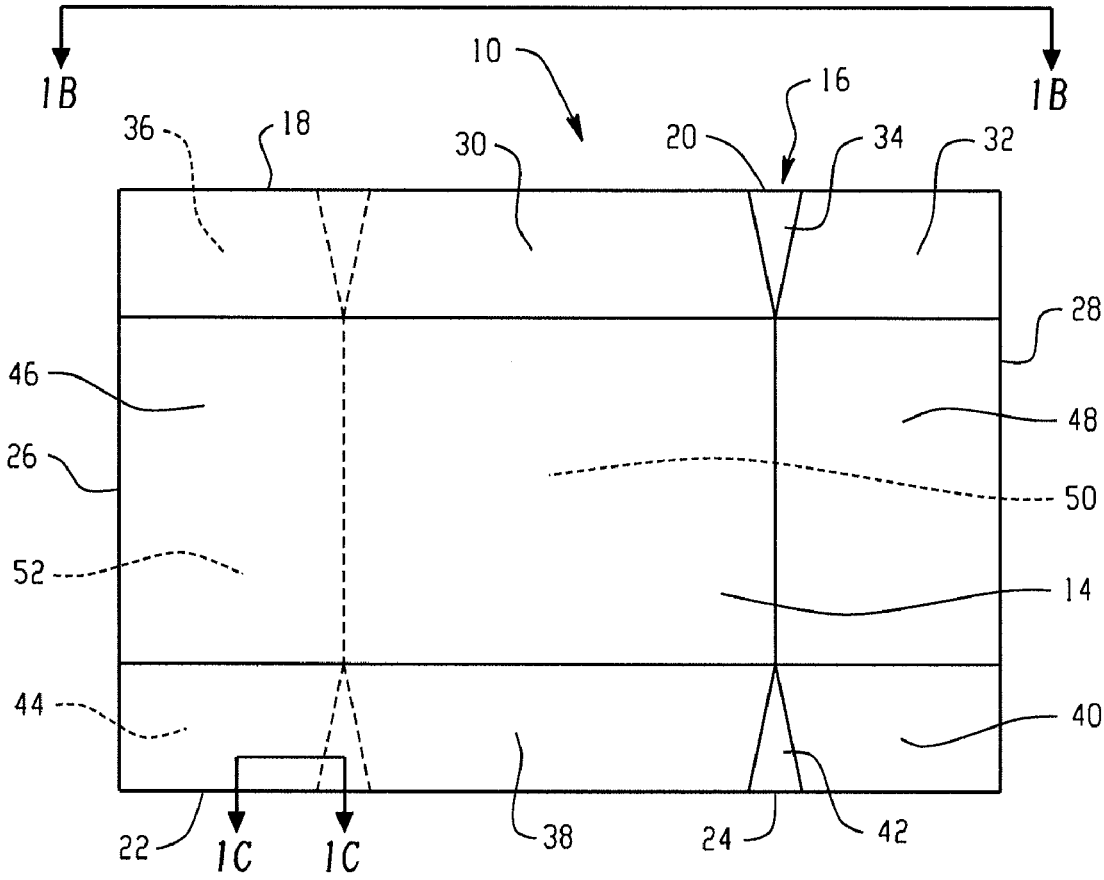
FIG. 1A is a front view of an embodiment of a case blank.
Figure 1B:
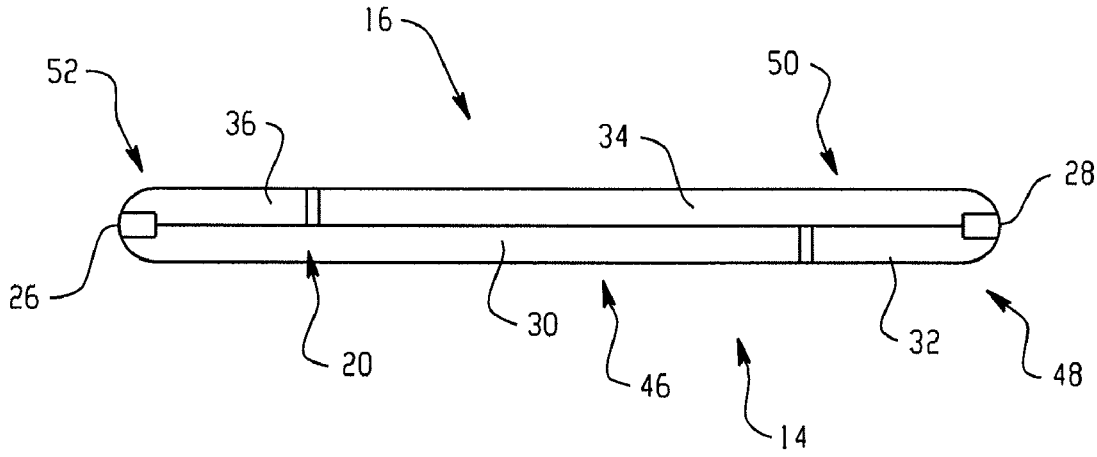
FIG. 1B is a top view of the case blank of FIG. 1A.
Figure 2:
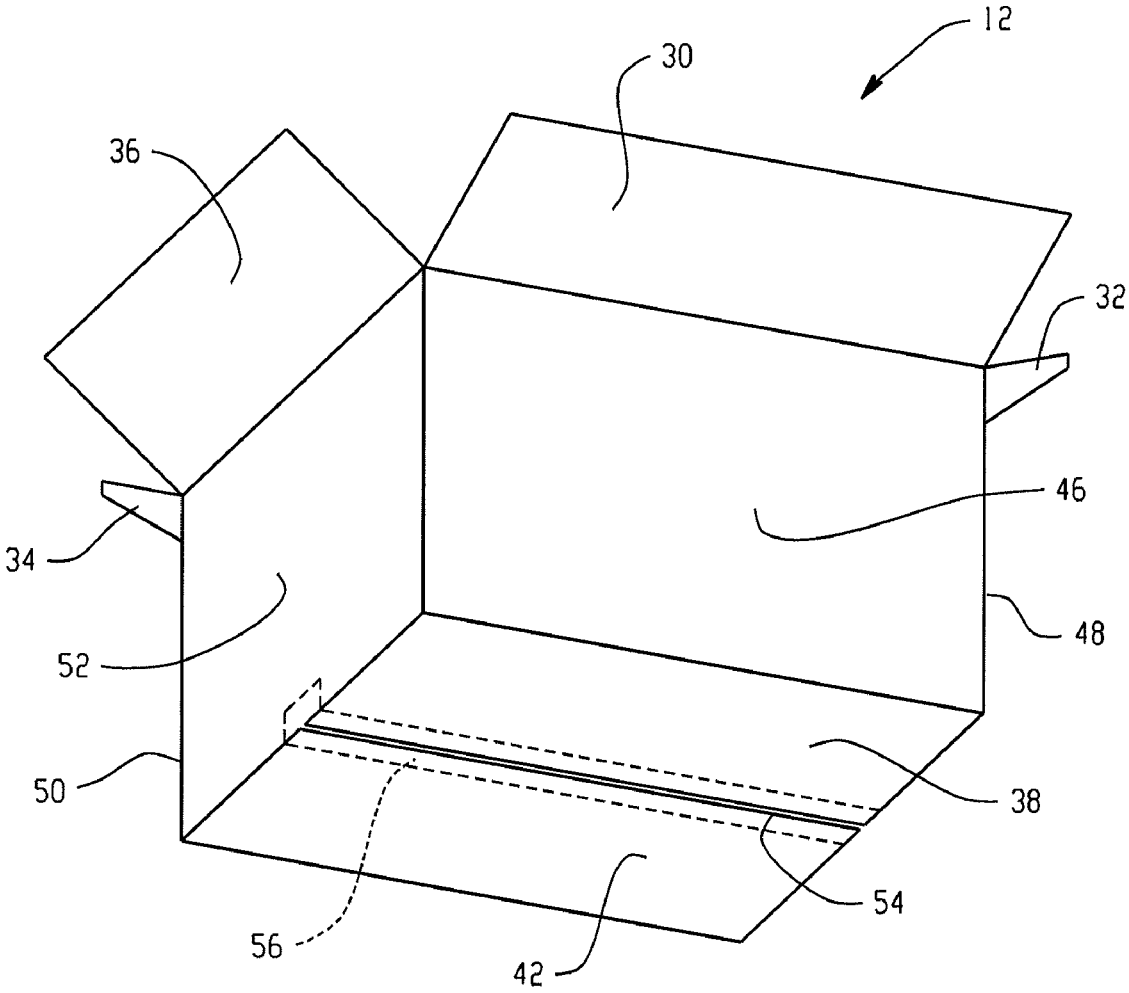
FIG. 2 is a perspective view of a bottom of a case formed from the case blank of FIG. 1A.

FIGS. 1A and 1B show an exemplary case blank 10 in a flat orientation and FIG. 2 illustrates a case 12 erected from the case blank and bottom sealed. Case blank 10 includes opposite, broad faces 14 and 16, each with a top edge 18, 20 and a bottom edge 22, 24. Side edges 26 and 28 connect the opposite faces 14 and 16. Top edge 18 is formed by top flaps 30 and 32 and top edge 20 is formed by top flaps 34 and 36. Bottom edge 22 is formed by bottom flaps 38 and 40 and bottom edge 24 is formed by bottom flaps 42 and 44. The faces 14 and 16 include respective panels 46, 48, 50, 52 that will form the vertical sidewalls of the erected case.

Referring to FIG. 2, panels 46 and 50 will form opposite sidewalls (also numbered 46 and 50) of the erected case 12 and panels 48 and 52 will form the other opposite sidewalls (also numbered 48 and 52) of the erected case. The top and bottom flaps 30, 38 and 34, 42 are associated with and hingedly connected to the sidewalls 46 and 50 and the top and bottom flaps 32, 40 and 36, 44 are associated with and hingedly connected to the sidewalls 48 and 52. As used herein, the term "opposite panels" refer to those pairs of panels 46 and 50, 48 and 52 opposite each other with respect to the erected case 12 and the term "adjacent panels" refer to adjacent panels (e.g., panels 46 and 52) with respect to the erected case. Similarly, the term "opposite flaps" refer to those top and bottom flaps 30 and 34, 38 and 42 associated with and hingedly connected to the opposite panels 46 and 50 and to those top and bottom flaps 32 and 36, 40 and 44 associated with and hingedly connected to the opposite panels 48 and 52. As can be seen in FIG. 2, opposite panels 46 and 50 and their associated bottom flaps 38 and 42 extend substantially parallel to a bottom seam 54 that is sealed by using glue or tape 56 (represented by broken lines). Note that in FIG. 1, the opposite panels 46 and 50, 48 and 52 and opposite flaps 30 and 34, 32 and 36, 38 and 42, 40 and 44 are offset from each other when the case blank is in the flat configuration.

In some embodiments, such as the one shown by FIGS. 1 and 2, panels 46 and 50 are wider than panels 48 and 52. The wider panels 46 and 50 may be referred to as "major panels" and the narrower panels 48 and 52 may be referred to as "minor panels." The flaps 30, 34, 38, 42 associated with and hingedly connected to the major panels 46 and 50 may be referred to as "major flaps" and the flaps 32, 36, 40, 44 associated with and hingedly connected to the minor panels 48 and 52 may be referred to as "minor flaps." However, in other embodiments, the panels (and flaps) may be all substantially the same width.

Figure 1C:
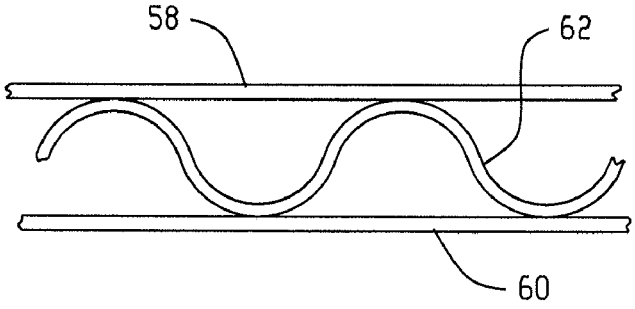
FIG. 1C is a section view the case blank along line 1C-1C of FIG. 1A.

Referring to FIG. 1C, each panel and/or flap of the case blank 10 may be formed of laminate material including spaced-apart outer layers 58 and 60 with an intermediate layer 62 of a corrugated medium. In some embodiments, the layers 58, 60 and 62 are formed of cardboard or paperboard material.

Figure 3:
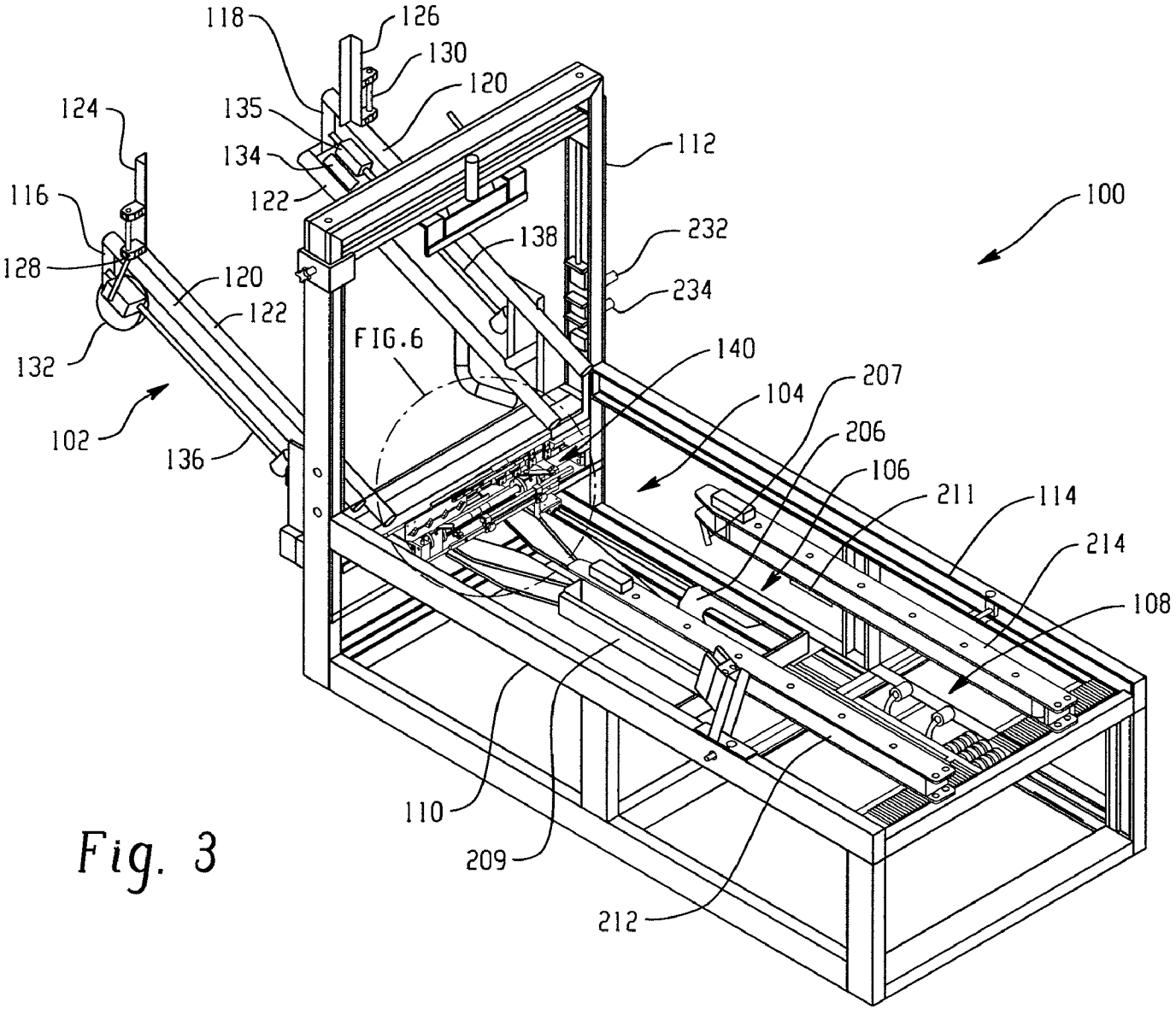
FIG. 3 is a perspective view of an embodiment of a case erector and sealer apparatus for forming the case of FIG. 2 from the case blank of FIG. 1A.
Figure 4:
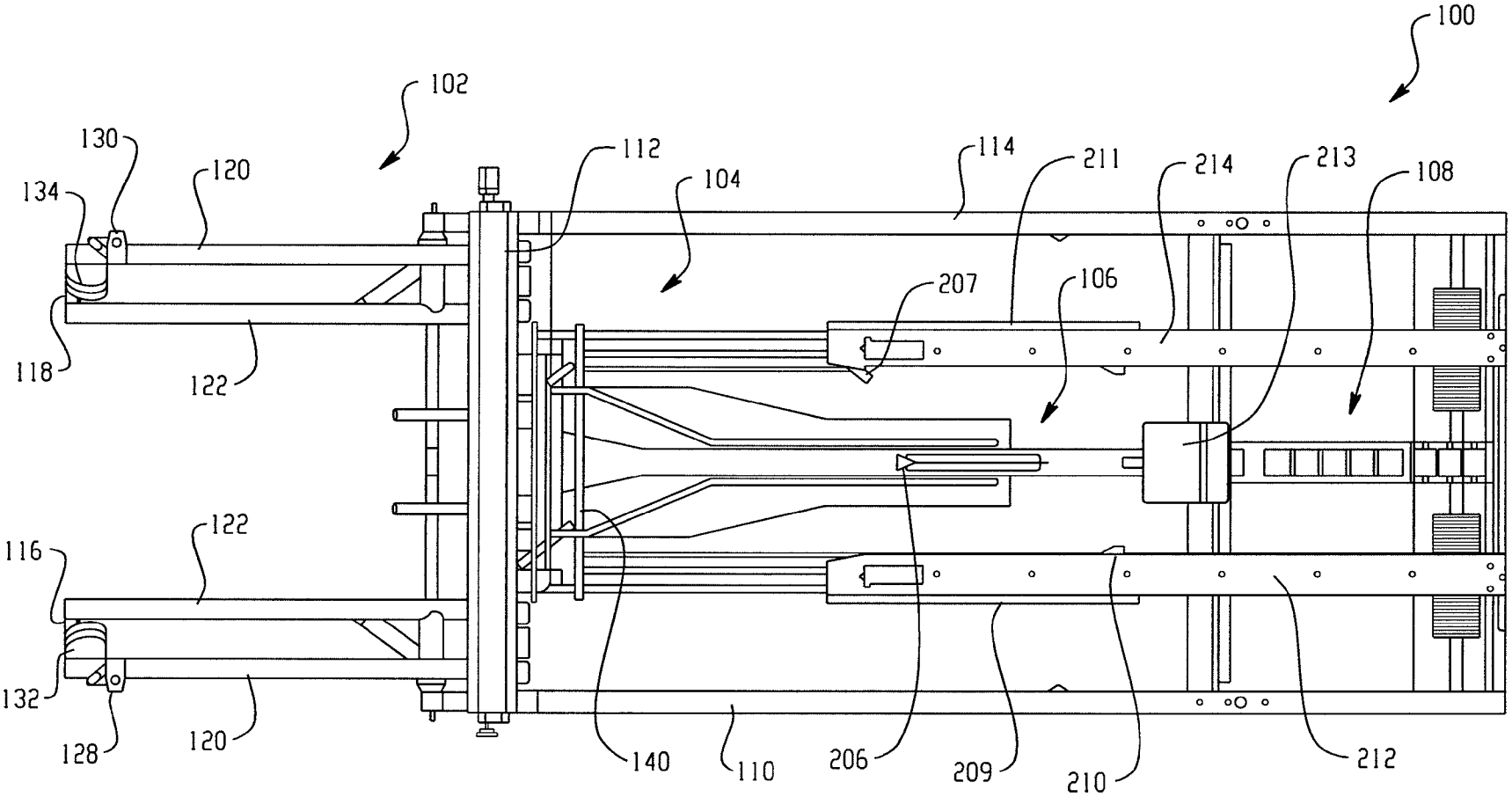
FIG. 4 is a top view of the case erector and sealer apparatus of FIG. 3.

Referring to FIGS. 3 and 4, a case erector and sealer apparatus 100 is shown for automatically erecting case blank 10 and applying the adhesive, such as tape 56 (FIG. 2). The erector and sealer apparatus 100 includes a case blank feeder 102, a case erecting portion 104, a flap folding portion 106 and a case sealing portion 108. Collectively, portions 104 and 106 form a case bottom fold and seal station of the apparatus. The case blank feeder 102, case erecting portion 104, flap folding portion 106 and case sealing portion 108 are all supported by a frame 110 that includes a vertically-oriented infeed assembly 112 through which case blanks are fed from the case blank feeder 102 to the case erecting portion 104 and a horizontally-oriented conveying assembly 114 along which the case blanks 10 conveyed while being erected and sealed.

Figure 5:
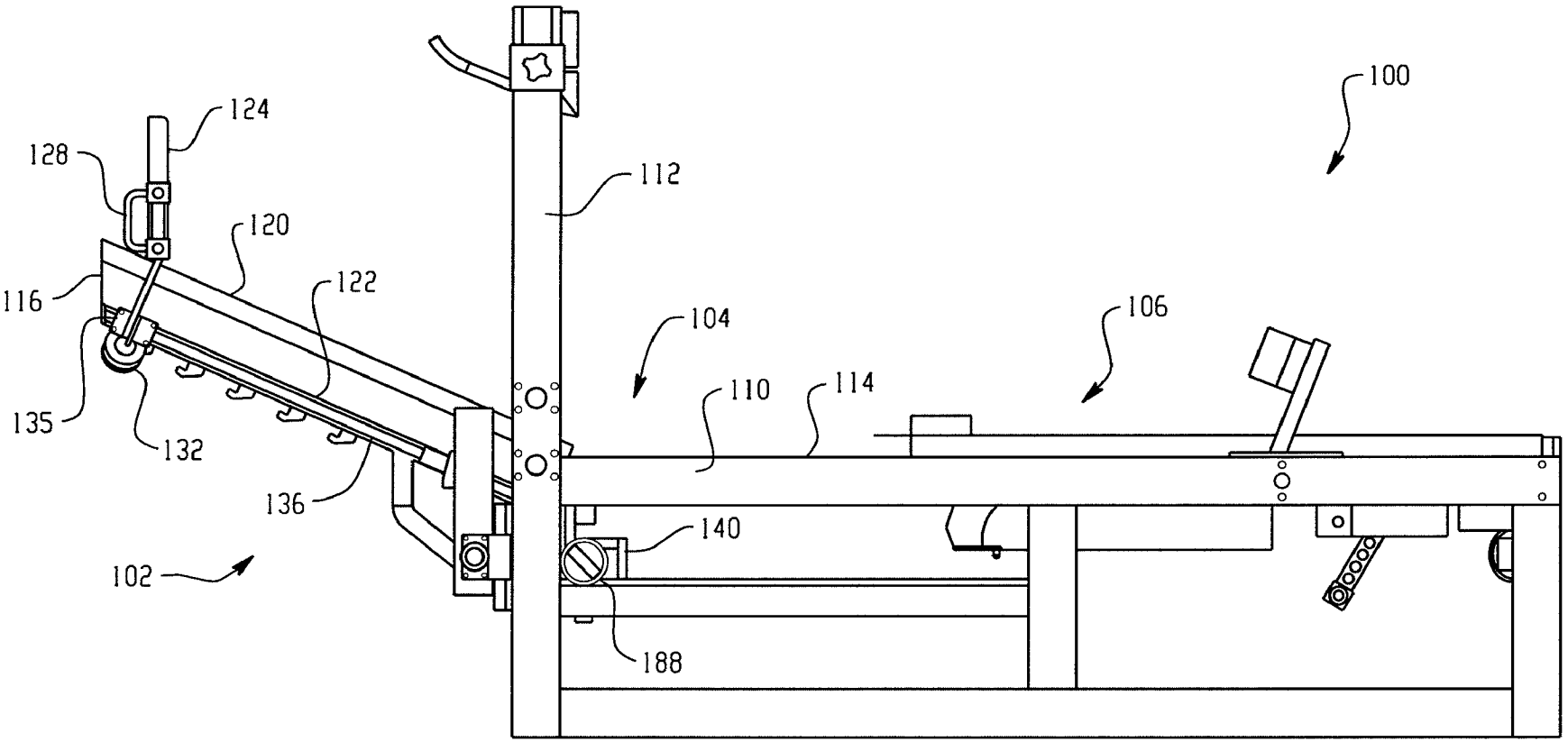
FIG. 5 is a side view of the case erector and sealer apparatus of FIG. 3.

Referring also to FIG. 5, the case blank feeder 102 includes a pair of sloped feed members 116 and 118 having an L-shape for receiving bottom corners of the case blanks including a vertical portion 120 and a horizontal portion 122 that is substantially transverse to the vertical portion. The sloped feed members 116 and 118 are sloped downwardly toward the infeed assembly 112 to facilitate movement of the case blanks located thereon toward the infeed assembly. A pusher 124 and 126 is associated with the sloped feed members 116 and 118. The pushers 124 and 126 are also L-shaped for pushing the carton blanks at their sides. Each pusher 124 and 126 is linked by a linkage 128 and 130 to a linear bearing 135 that rides along a track bar 136, 138. In some embodiments, the pushers 124 and 126 move down the sloped feed members 116 and 118 under the influence of a weight 132, 134 and gravity to push the carton blanks toward the infeed assembly 112. The pushers 124 and 126 are able to rotate about the track bars 136 and 138. The weights 132 and 134 are offset inwards toward the infeed assembly 112 so as to create a tendency for the pushers 124 and 126 to rotate inward toward each other. This rotation is limited by rollers riding on the sloped feed members 116, 118 so that the pushers 124 and 126 remain vertical. If the pushers 124 and 126 are rotated outward and pulled back to allow more case blanks to be added to the case blank feeder 102, they will return to a vertical position to push squarely on the end of the case blanks. Alternatively, the pushers 124 and 126 may be moved using actuators, such as a pneumatic actuator, motor and linkage assembly, etc.

Figure 6:
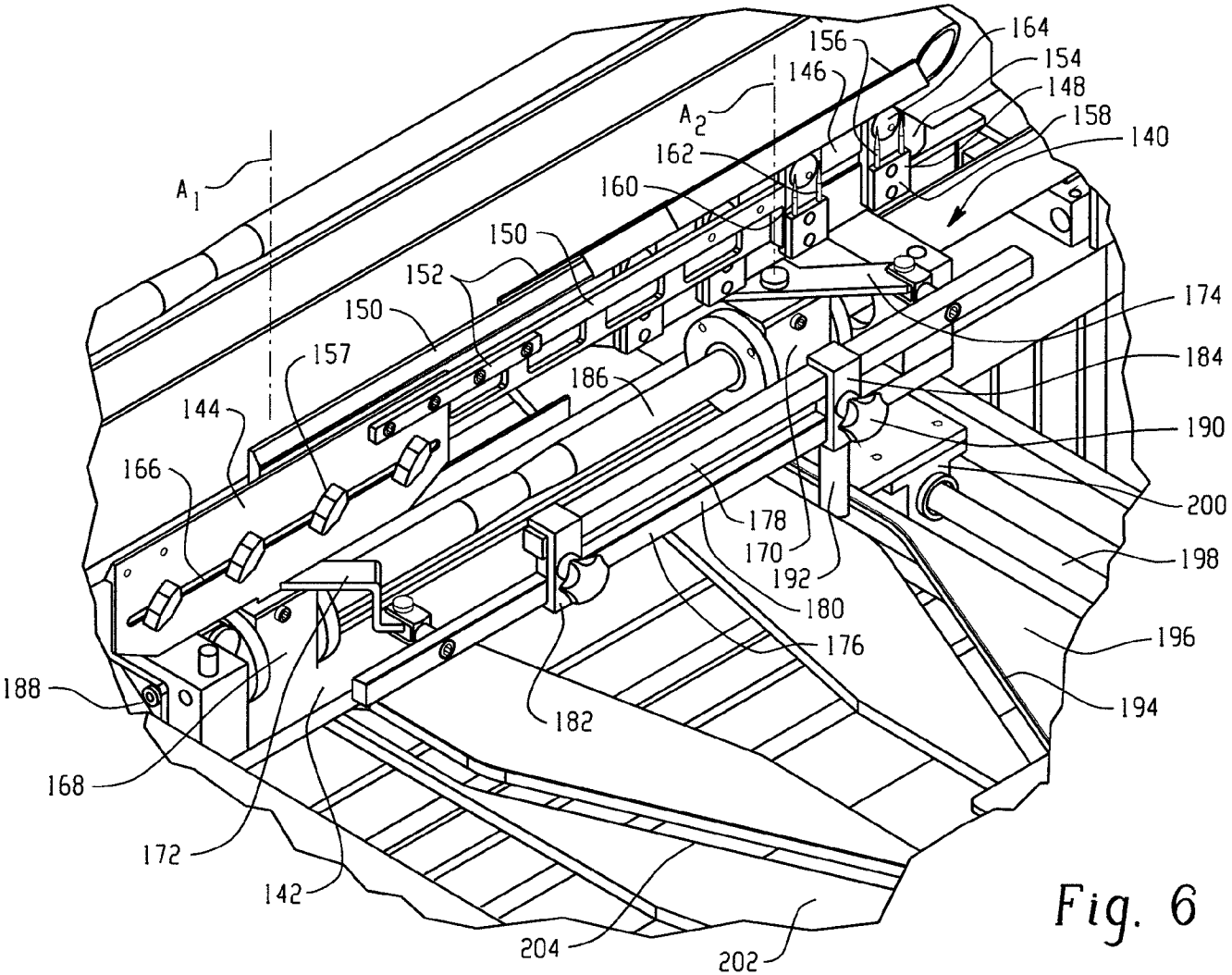
FIG. 6 is a detail, perspective view of a case erector device within area 6 of the case erector and sealer apparatus of FIG. 5.
Figure 7:
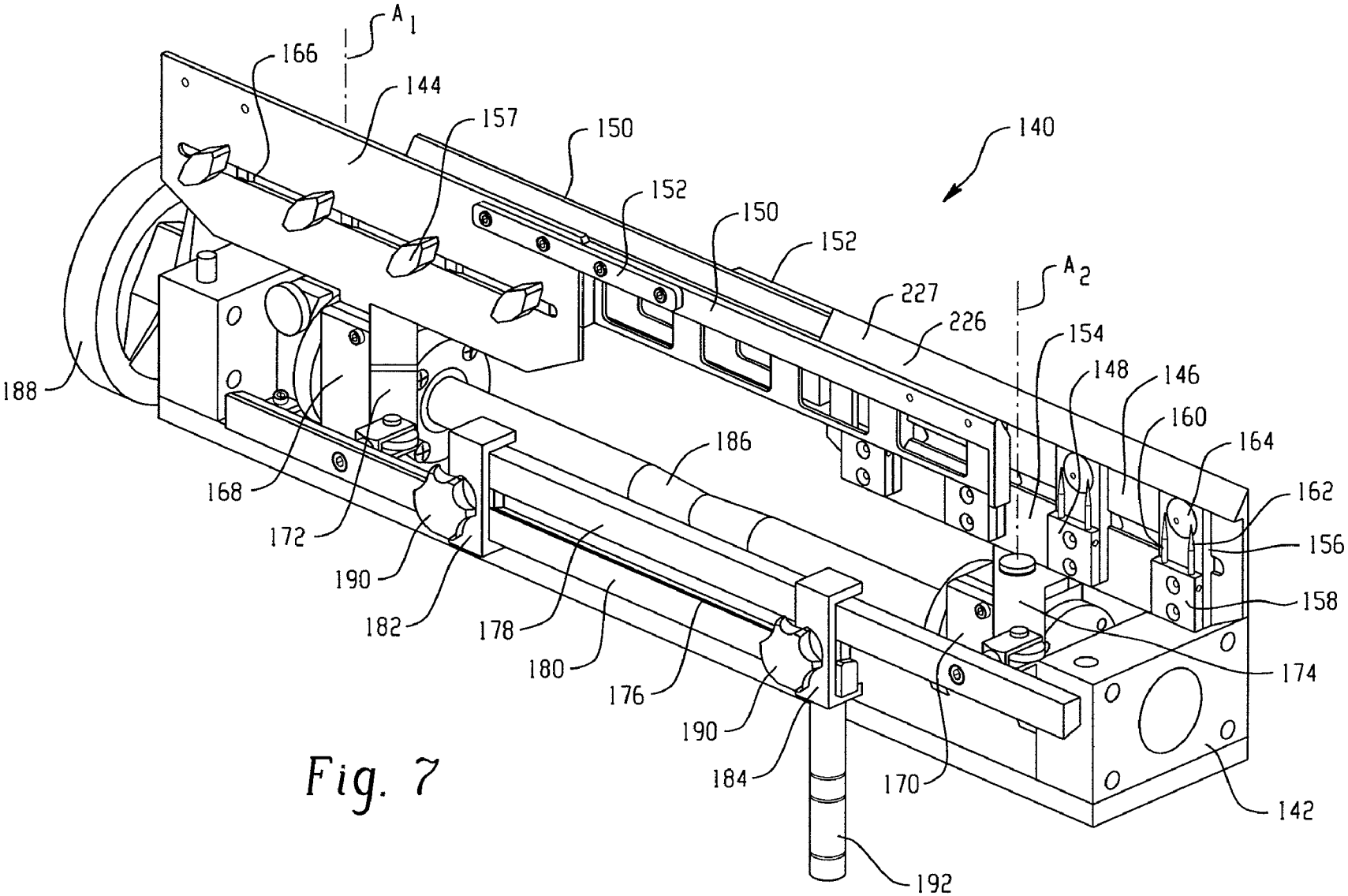
FIG. 7 is a perspective view of the case erector device of FIG. 6 shown in isolation.

A case erector device 140 is located at the infeed assembly 112. Referring to FIGS. 6 and 7, the case erector device 140 includes a conveying mount frame 142 that carries a first moveable arm 144 and a second moveable arm 146. Each moveable arm 144 and 146 includes one or more, in this instance, four gripping devices 148 for gripping a bottom flap (e.g., see flaps 38, 40, 42, 44 of FIG. 1) of the case blank and an extended support member 150 connected to each moveable arm by a connecting member 152. In the illustrated embodiment, the gripping devices 148 are pin and dome combinations (also labeled element number 148), which are mounted on a vertical face 154 of the respective moveable arms 144 and 146. However, other gripping devices can be used, such as suction cups, other mechanical grippers such as those with moveable fingers, etc. Pin-only gripping devices without the dome may also be used.

The pin and dome combinations 148 include a panel or block 156 that is mounted to the associated face 154 by a fastener 157, in this case a thumb screw or alternatively a flat head screw fastener. A mounting block 158 is mounted to the lower end of the panel 156. Each mounting block 158 is provided with at least one passage, in this implementation, two substantially parallel passages through which holding pins 160 and 162 pass. As can be seen, the holding pins 160 and 162 are pointed vertically upward toward a dome 164 mounted on an upper end of the panel 156. The holding pins 160, 162 and dome 164 are located relative to each other such that a laminate layer 58, 60 (FIG. 1A) of the laminate material forming the case blank can be gripped therebetween. This gripping of the laminate material is described in greater detail in U.S. Pat. No. 4,553,954. In some embodiments, the pins 160, 162, mounting block 158 along with the pins, and/or dome 164 may be vertically moveable along the panel 156 between release and gripping positions thereby adjusting the space between the dome and the pins. One such adjustable pin and dome combination is described in U.S. Pat. No. 7,192,393.

In the embodiment shown, the positions of the pin and dome combinations 148 are adjustable by loosening the thumb screw 157 and moving the pin and dome combinations along the lengths of their respective moveable arms 144 and 146 within lengthwise slots 166 of the panels. This allows for adjustment of the distance between adjacent pin and dome combinations 148 to accommodate cases of various dimensions. Pin and dome combinations 148 may also be removable from their associated moveable arm 144, 146 manually, for example, without any need for tools.

The first and second moveable arms 144 and 146 are pivotally mounted at respective axes $A_1$ and $A_2$ to a respective mounting block 168 and 170 by respective linkages 172 and 174. The linkages 172 and 174 are each connected to a follower assembly 176 of the case erector device 140 that moves along with the conveying mount frame 142. The follower assembly 176 includes a pair of overlapping rods 178 and 180 where linkage 172 is connected directly to rod 180 and linkage 174 is connected directly to rod 178. The rods 178 and 180 are adjustably connected together where they overlap by brackets 182 and 184.

An adjustment member 186 allows for adjustment of a distance between the moveable arms 144 and 146. In the illustrated embodiment, the adjustment member 186 is threadably connected to each mounting block 168 and 170 through left-handed and right-handed threads respectively (not shown) such that rotation of the adjustment member 186 (e.g., manually using wheel 188) causes either a decrease or an increase in the distance between the moveable arms along the length of the adjustment member depending on the direction of adjustment member rotation. Typically, fasteners 190 of the brackets 182 and 184 are loosened to allow for movement of the rods 178 and 180 along with their respective moveable arms 144 and 146 as the distance between them is being adjusted using the adjustment member 186. When the distance between the moveable arms 144 and 146 is at the desired distance (which, in the illustrated embodiment, is set according to case blank size so that the gripping devices will engage opposite bottom flaps of the case blank), the fasteners 190 can be tightened thereby locking the rods 178 and 180 together.

A follower pin 192 extends downwardly from the bracket 184 and is received within a cam track 194 formed in plate 196. The shape of the cam track 194 causes the follower assembly 176 to move linearly in a cross-conveying direction as the case erector device 140 is moved in the conveying direction. Movement of the follower assembly 176, in turn, causes movement of the linkages 172 and 174 and their moveable arms 144 and 146 about their respective pivot axes $A_1$ and $A_2$. Alternatively, the function of the cam track 194 and follower pin 192 could be performed by an actuator, such as a pneumatic cylinder or servo actuator. The case erector device 140 is slidably connected to guide rods 198 (only one can be seen in FIG. 6) using linear bearing guides 200 (only one can be seen in FIG. 6) that receive the rods and slide therealong. As can be seen, adjacent plate 202 includes another cam track 204 that is a mirror of cam track 194 and can be used in changing a configuration of the case erector device 140 from a right hand opening configuration as shown to a left hand opening configuration, which is described below.

Figure 8:
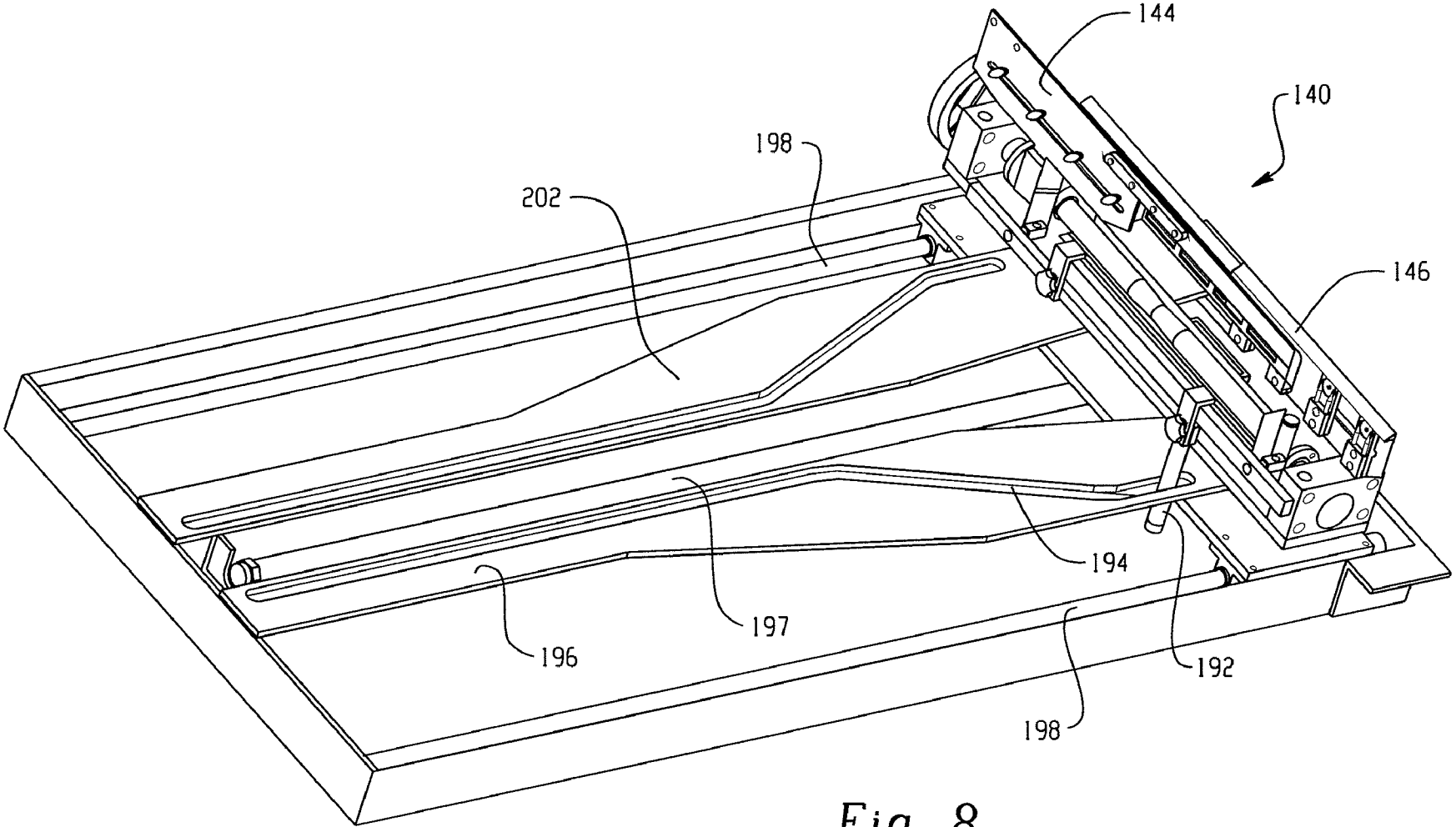
FIGS. 8-10 illustrate operation of the case erector device of FIG. 6.
Figure 9:
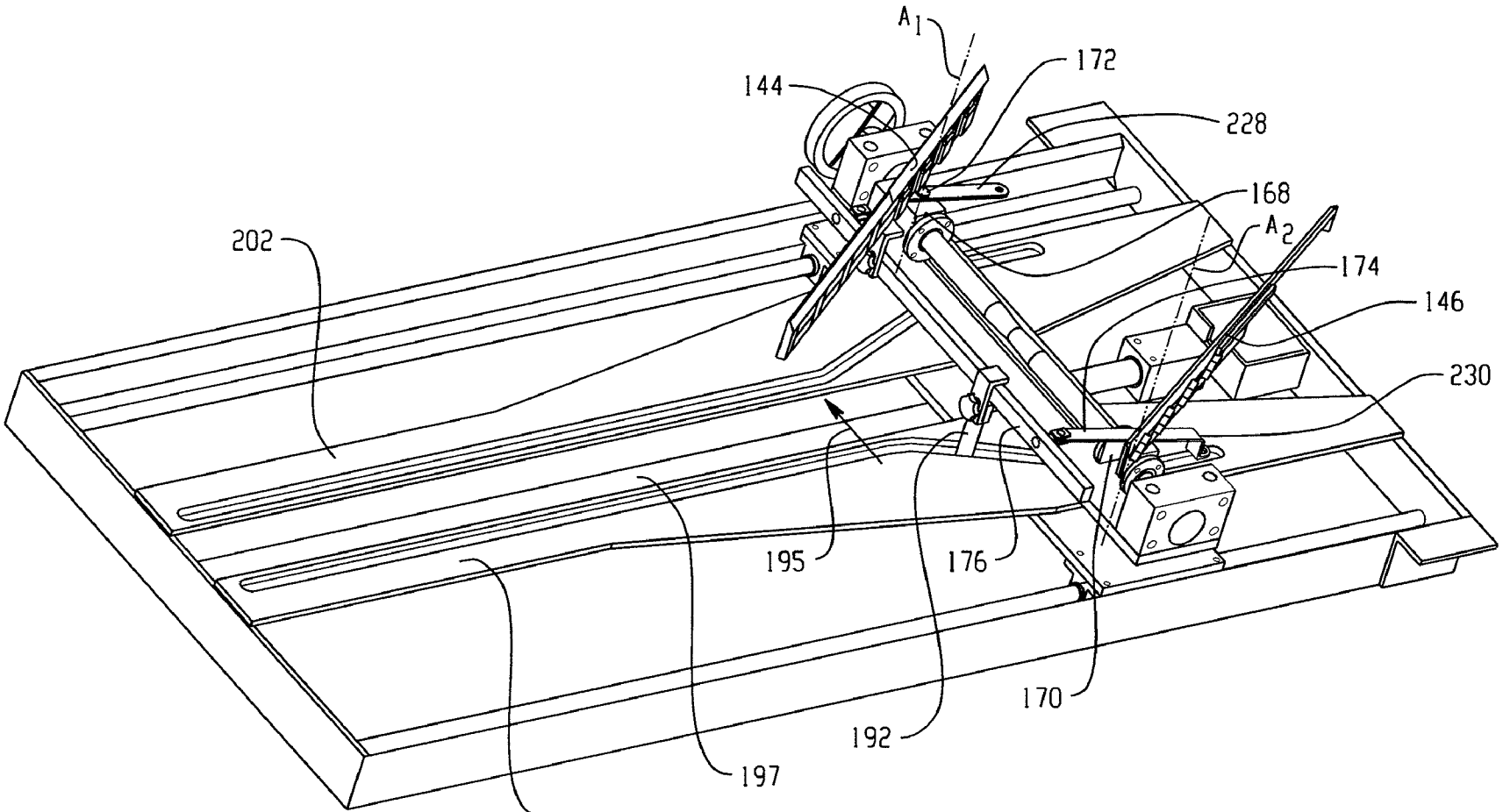
Figure 10:
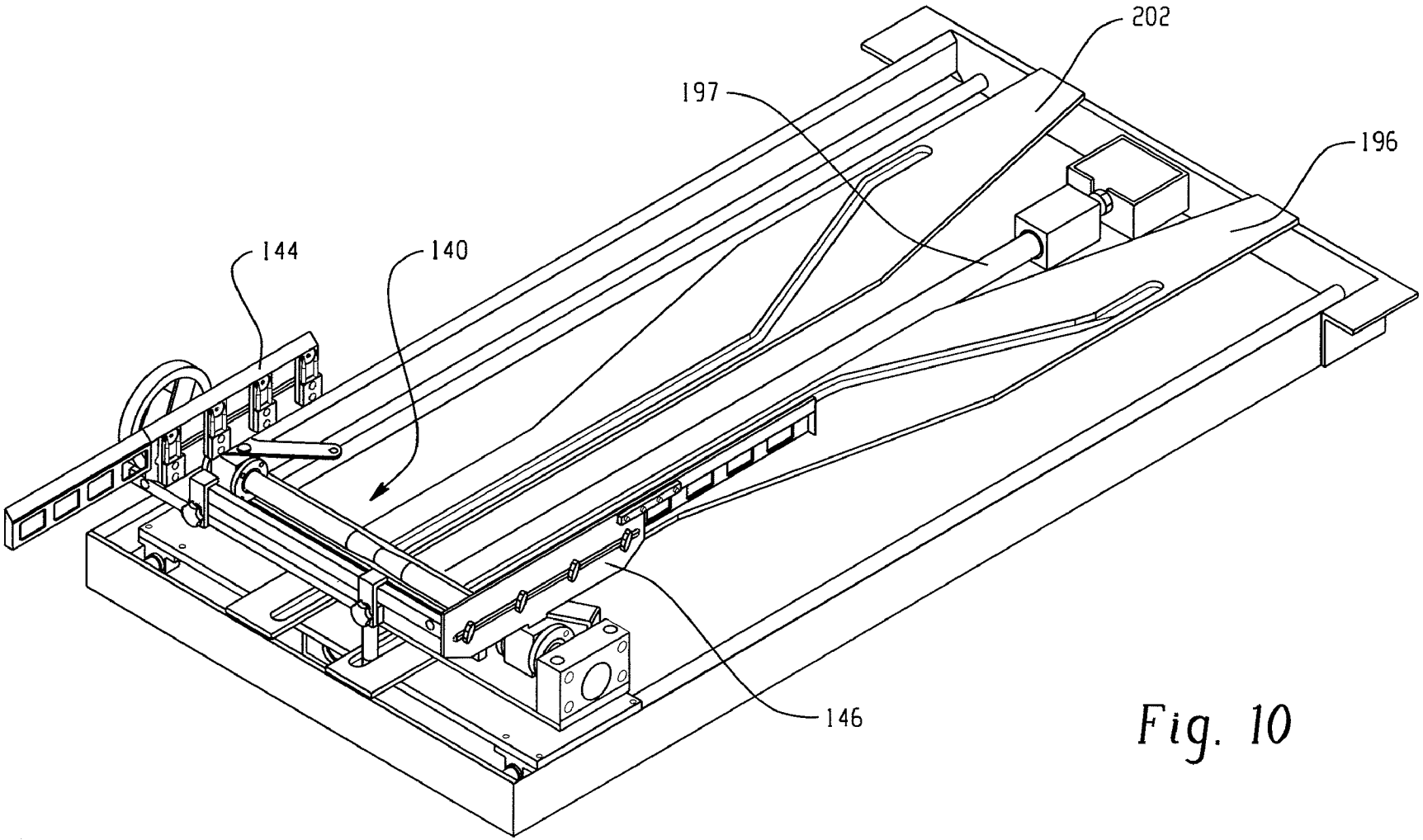

FIGS. 8-10 illustrate operation of the case erector device 140 as it is moved in the conveying direction through the apparatus 100 with the case erector device and the plates 196 and 202 shown in isolation. Referring first to FIG. 8, the case erector device 140 is moved linearly in the conveying direction along guide rods 198, for example, using a linear actuator 197, such as a pneumatic cylinder (not shown) with the follower pin 192 located in the cam track 194. Servo motor drives could also be used. The moveable arms 144 and 146 are initially parallel to each other and extend in the cross-conveying direction. Referring to FIG. 9, as the case erector device 140 moves in the conveying direction toward the bottom fold and seal station, the follower pin 192 moves in the cross-conveying direction (in the direction of arrow 195) relative to the mount frame 142 and the mounting blocks 168 and 170 due to the shape of the cam track 194. This movement of the follower pin 192 results in corresponding movement of the follower assembly 176 which, in turn, results in movement of the linkages 172 and 174 and their moveable arms 144 and 146 about their respective pivot axes $A_1$ and $A_2$. FIG. 10 illustrates the moveable arms 144 and 146 in their fully rotated configurations where they are parallel to each other and extend in the conveying direction.

Referring back to FIGS. 3 and 4, the flap folding portion 106 is provided for folding the bottom flaps of the opened case blank. The flap folding portion 106 includes a leading bottom flap folding member 206 (FIG. 3) that is used to fold a leading bottom flap of the erected case blank as it passes thereover, a trailing bottom flap folding member 207 part of flap folder 211 and its mirror opposite 209, a modification of the device described in U.S. Pat. No. 5,440,842 that is used to fold a trailing bottom flap of the erected case blank and side bottom flap folding guides 208 and 210 (FIG. 4) that are used to finish folding the side bottom flaps as they pass thereby (and after the gripping devices 148 have been removed therefrom as will be described), after the leading and trailing bottom flaps are folded. In some embodiments, the trailing bottom flap folder is an actuated member that is moved to fold the trailing bottom flap based on a signal from a position sensor (e.g., a non-contact sensor) that senses when the erected case is in an appropriate position.

In some embodiments, the leading bottom flap folding member 206 is positioned such that the frame 142 of the case erector device 140 can pass thereunder as the leading bottom flap is folded and while the side bottom flaps are gripped by the gripping devices 140 carried by the respective moveable arms 144 and 146. The case erector device 146 can then locate the erected case between a pair of side conveyors 212 and 214 where the rear bottom flap is folded and the side bottom flaps are folded. The side conveyors 212 and 214 then carry the erected case through the case sealing portion 108 where an adhesive tape is applied along the seam between the side bottom flaps.

Figure 11:
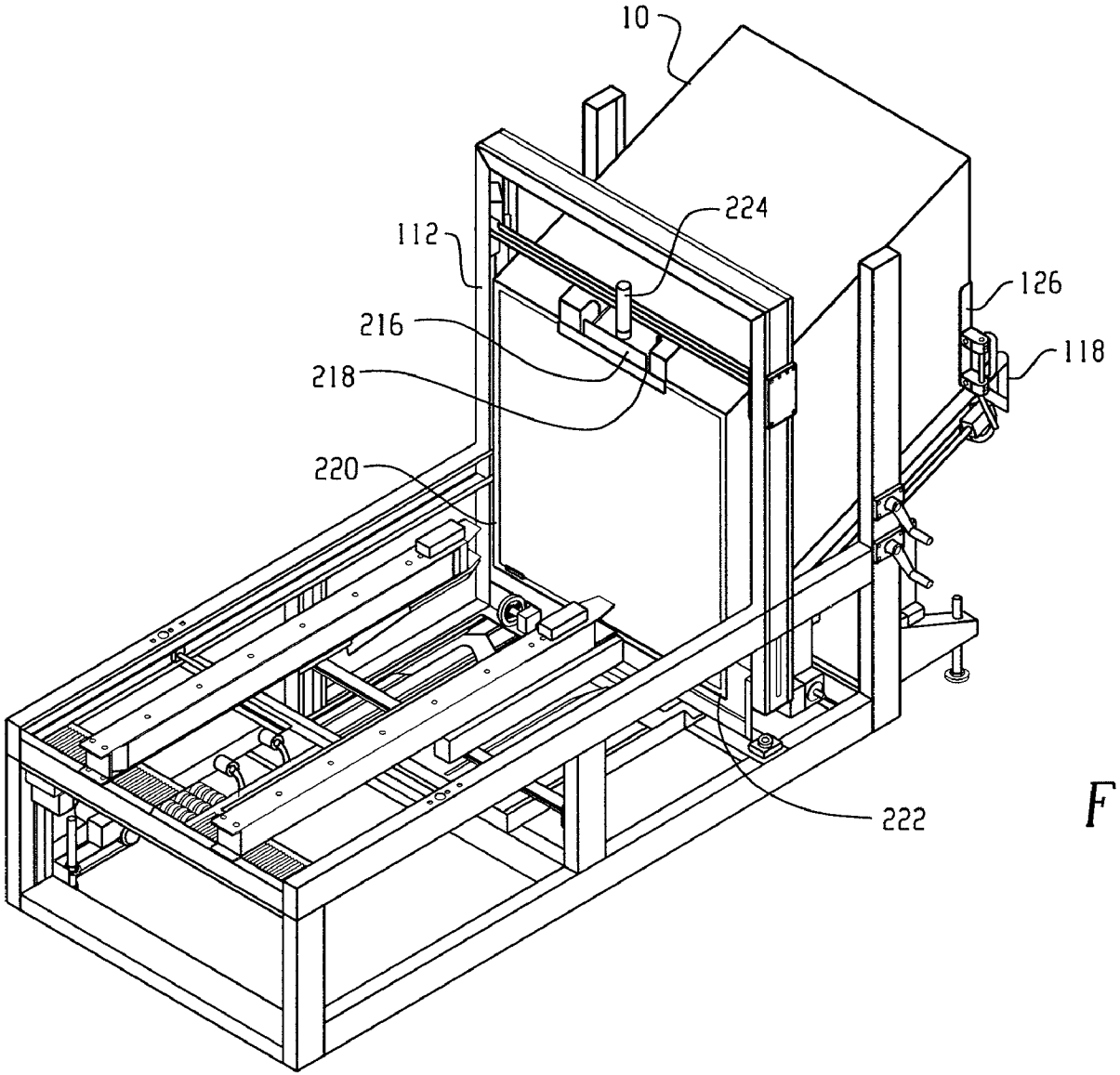
FIGS. 11-15 illustrate operation of the case erector and sealer apparatus of FIG. 3 erecting and sealing a case.

FIGS. 11-15 illustrate operation of the case erector and sealer apparatus 100 to erect a case from a case blank. Referring initially to FIG. 11, a series of upstanding case blanks 10 are stacked face-to-face on the feed members 116 and 118 of the case blank feeder 102. The pushers 124 and 126 (only pusher 126 and feed member 118 can be seen) apply a pushing force against the case blanks 10 in a direction toward the infeed assembly 112.

Figure 12:
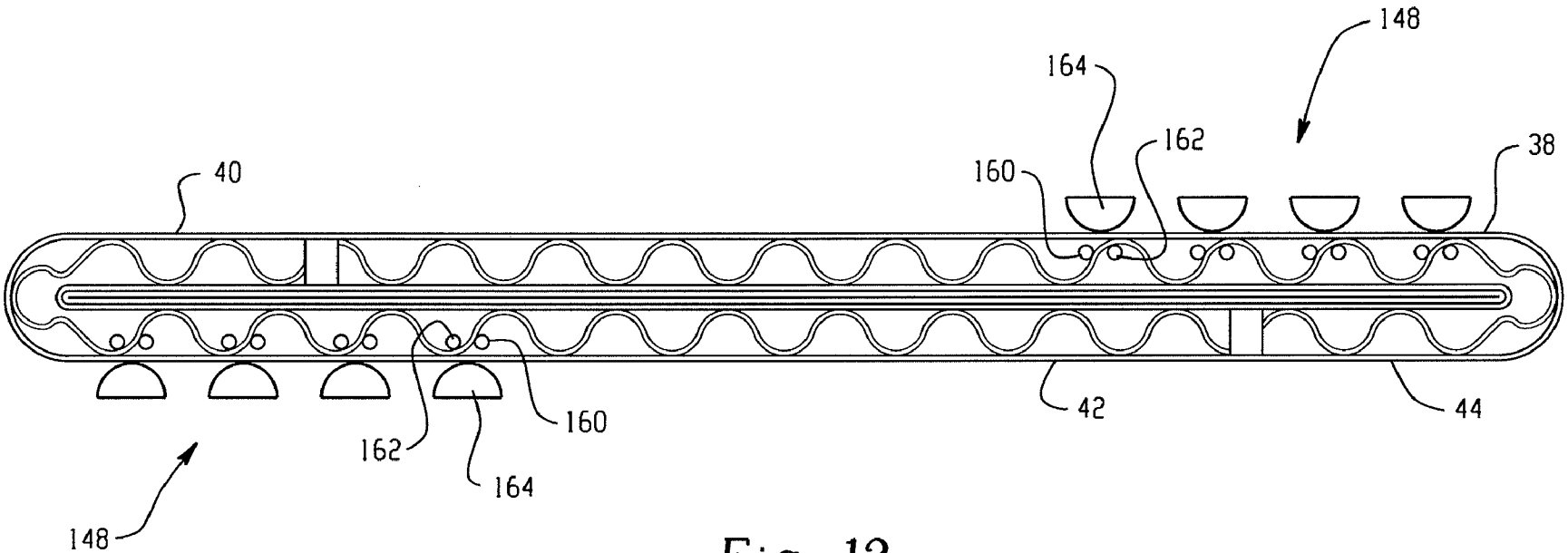

A case blank positioning device 216 is supported by the infeed assembly 112. The case blank positioning device 216 is L-shaped, having a vertical portion 218 that forms a stop for the leading case blank 10. Lower stops 220 and 222 are also used to provide a stop for the leading case blank 10 and to position lower, opposite flaps of the case blank just behind and above the moveable arms 144 and 146 of the case erecting device 140. Once the leading case blank 10 is positioned, two actuators, such as pneumatic cylinders located in the lower stops 220 and 222 actuate upward to separate and lift the leading case blank so that top edges of the top flaps are moved upward into the case blank positioning device 216. In doing so, the bottom flaps are freed from the stops 220 and 222 and can move forward to be positioned directly above the moveable arms 144 and 146 of the case erecting device 140. An actuator, such as pneumatic cylinder 224 is actuated thereby extending a part of the case blank positioning device 216 downward, pushing the opposite bottom flaps onto the pin and dome combinations 148 carried by the moveable arms 144 and 146. Referring briefly to FIG. 7, the moveable arms 144 and 146 each include a guide member 226 having a contoured surface 226 that is used to guide the bottom edge of opposite bottom flaps (e.g., the major flaps) onto the pins such that the pins penetrate into an open space between the outer layers and/or the grip the outer layer of the laminate material between the pins so inserted and the domes. As can be seen by FIG. 12, the pin and dome combinations 148 grip the outer layer of the opposite major flaps 38, 42 once the case blank 10 is pushed downward by the case blank positioning device 216.

Figure 13:
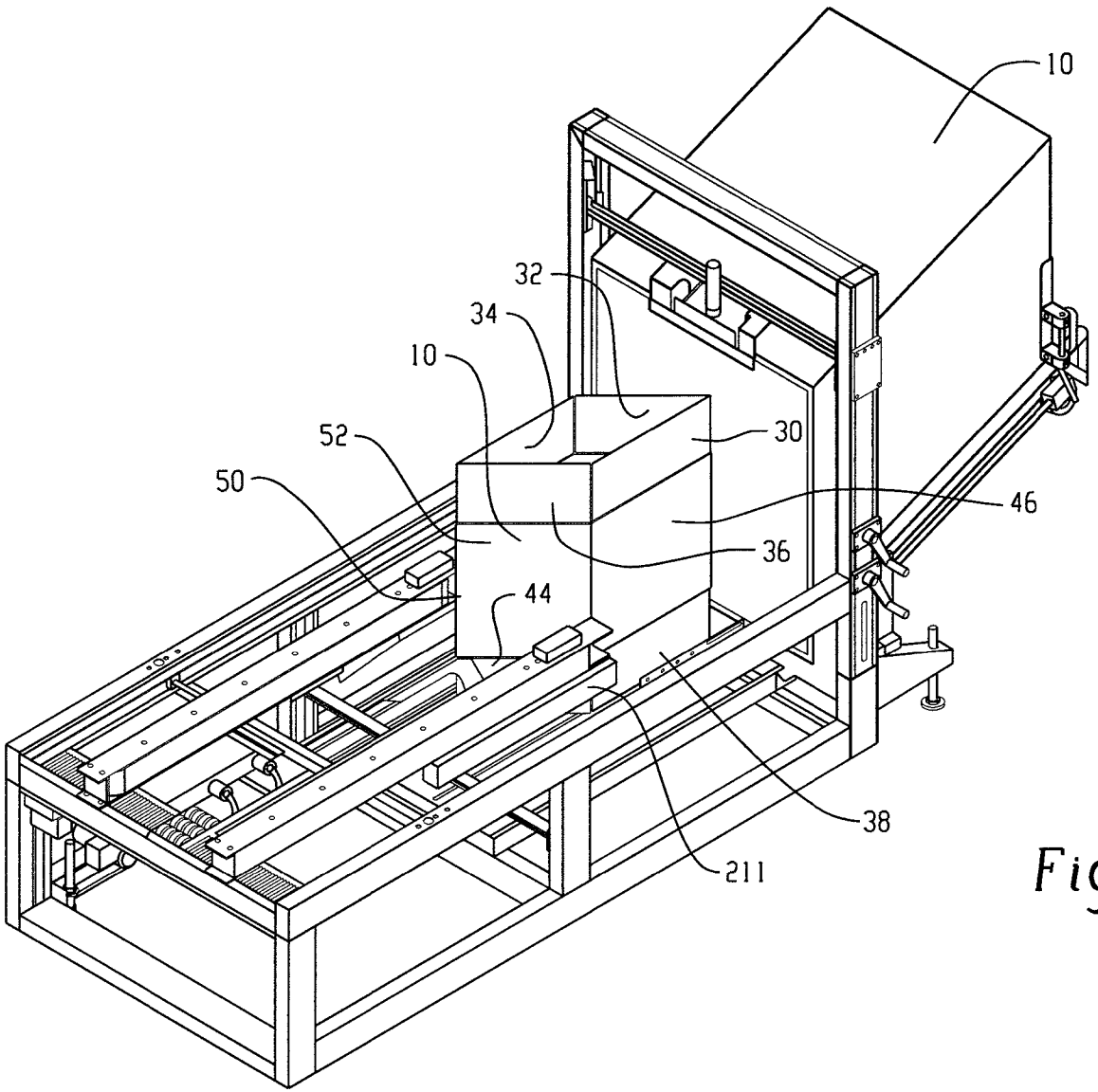
Figure 14:
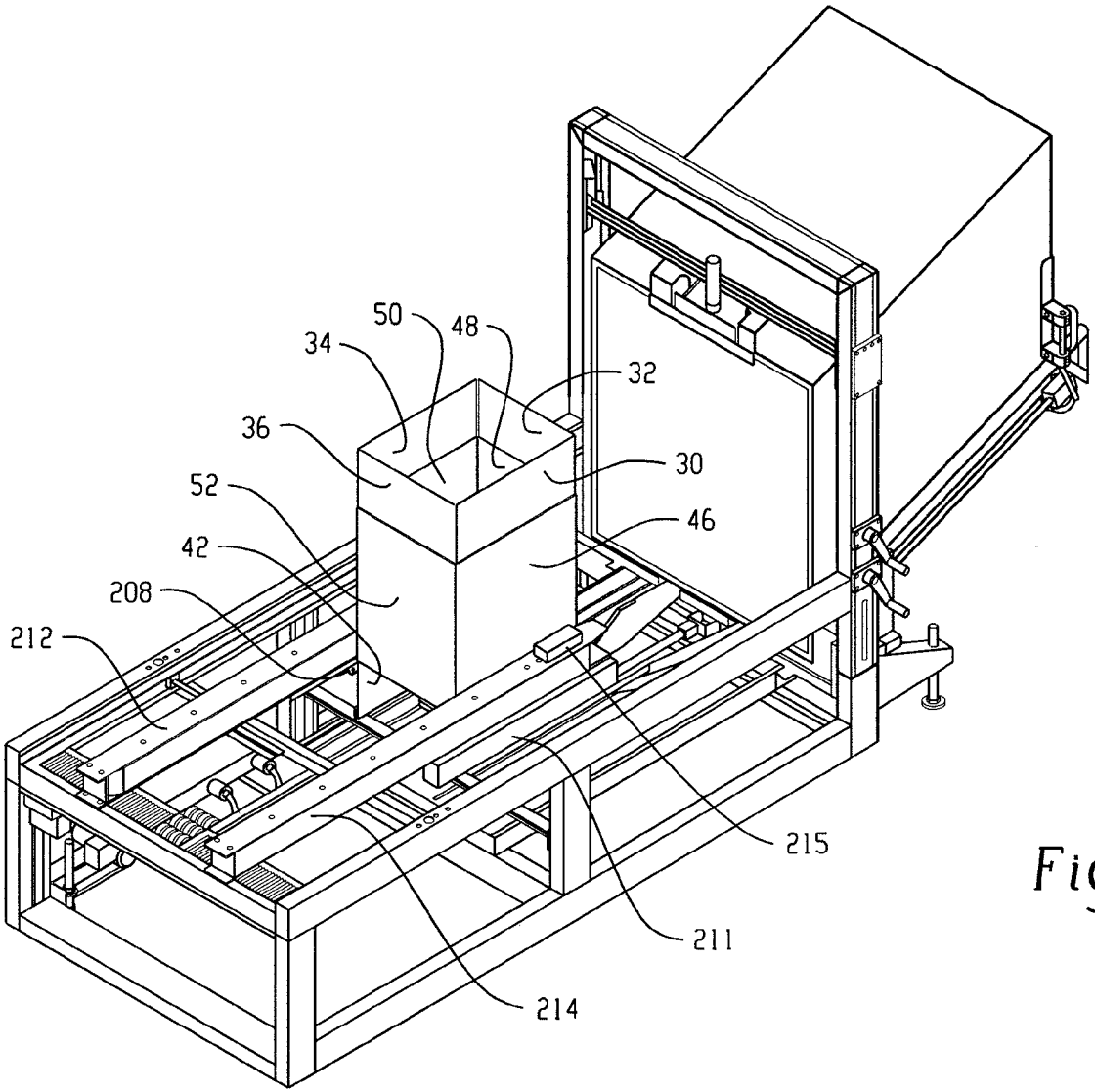

The case erecting device 140 is then moved horizontally in the conveying direction by a linear actuator, such as a pneumatic cylinder 197. Referring to FIG. 13, as described above, as the case erecting device 140 is moved, the moveable arms 144 and 146 rotate to begin to open (erect) the case blank 10 due to the cross-conveying direction movement of the follower assembly 176. The rotating motion of the moveable arms 144 and 146 both rotate the case blank 10 from a position where the major panels 46, 50 and flaps 38, 42 are oriented substantially parallel to the cross-conveying direction as shown by FIG. 11 through an intermediate stage as shown by FIG. 13 to a position where the major panels and flaps are oriented substantially parallel to the conveying direction and separate the major panels and flaps from each other in the cross-conveying direction as shown by FIG. 14.

Figure 15:
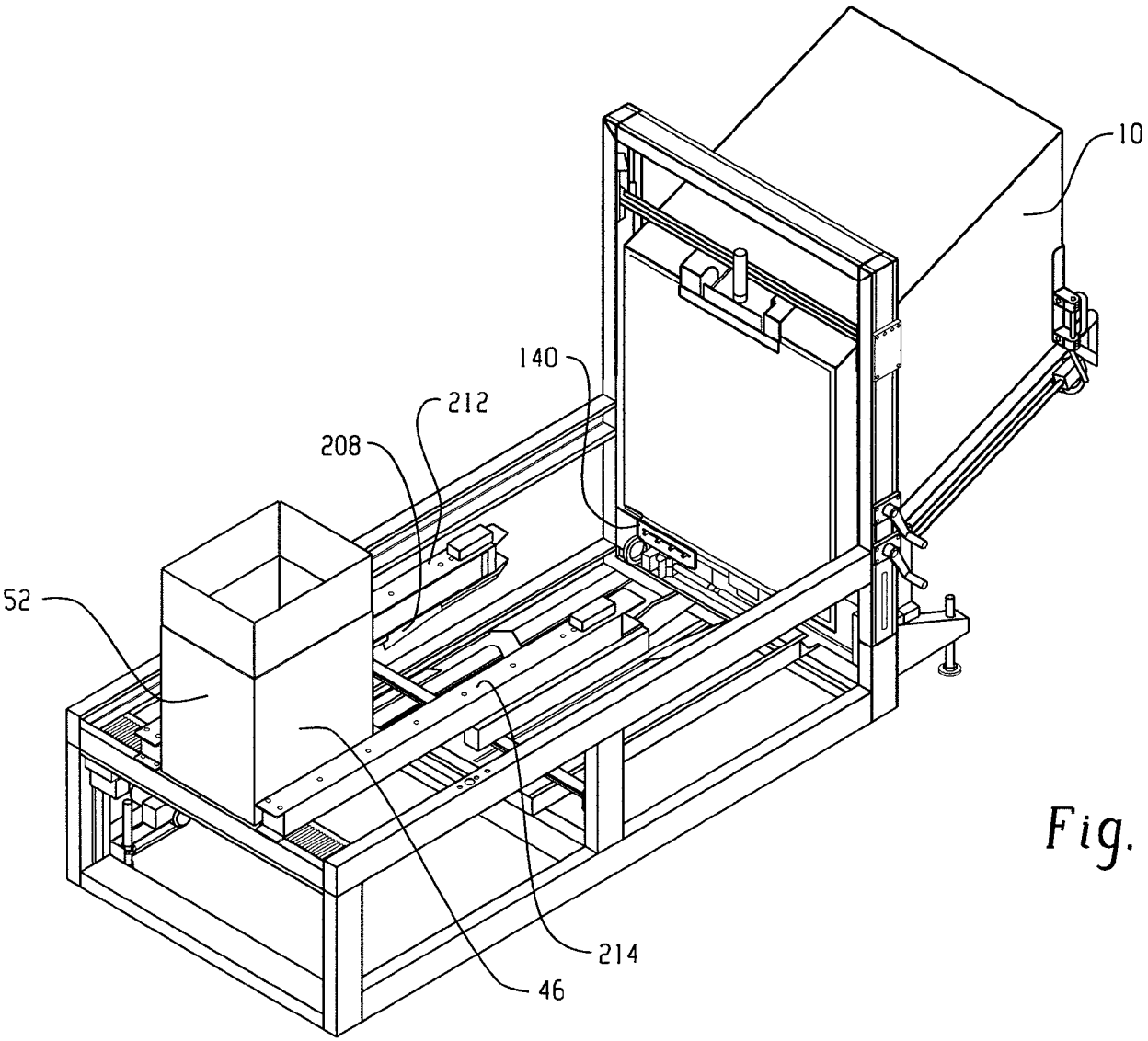

In some embodiments, the moveable arms 144 and 146 are capable of vertical movement relative to the mount frame 142 (or with the mount frame 142), for example, through use of linear actuators, such as pneumatic cylinders. Initially, in the position shown by FIG. 3, the case erecting device 140 and the moveable arms 144 and 146 are in their normal, elevated positions and remain in their elevated positions as they approach the flap folding portion 106 of the case erector and sealer apparatus 100. The case erecting device 140 carries the opened case blank 10 over the leading bottom flap folding member 206 such that the leading minor bottom flap is folded underneath the opened case blank, as shown by FIG. 14. After the leading, minor bottom flap is folded and the opened case blank 10 is held in position between the side conveyors 212 and 214, between the flap folders 209 and 211 and upstream of the side flap folding guides 208 and 210 (e.g., which may be detected by one or more sensor 215, such as a non-contact sensor), the rear bottom flap folding arms 207 (only one arm 207 can be seen) of folders 209 and 211 are actuated (e.g., by a first stage of a dual stage pneumatic cylinder) thereby folding the trailing bottom minor flap. The moveable arms 144 and 146 are then lowered thereby removing the pin and dome combinations 148 from the side major bottom flaps. The side flap folding guides 208 and 210 of folders 209 and 211 are then actuated (e.g., by the second stage of the dual stage pneumatic cylinder) as a second folding stage to fold the side major bottom flaps into a closed position. The opened case blank 10 is conveyed using the side conveyors 212 and 214 past the side flap folding guides 208 and 210 and over a center flap guide 213 (FIG. 4) which finish folding the side major bottom flaps. The case is then carried to and over the bottom sealing tape head by the side conveyors 212 and 214 where tape is applied along the bottom seam formed between the folded major bottom flaps as shown by FIG. 15. In some embodiments, the case erecting device 140 moves back to its initial, starting position as the case blank 10 is moved past the bottom sealing tape head. Additional details of this folding process is described below with reference to FIGS. 30-35.

Figure 16:
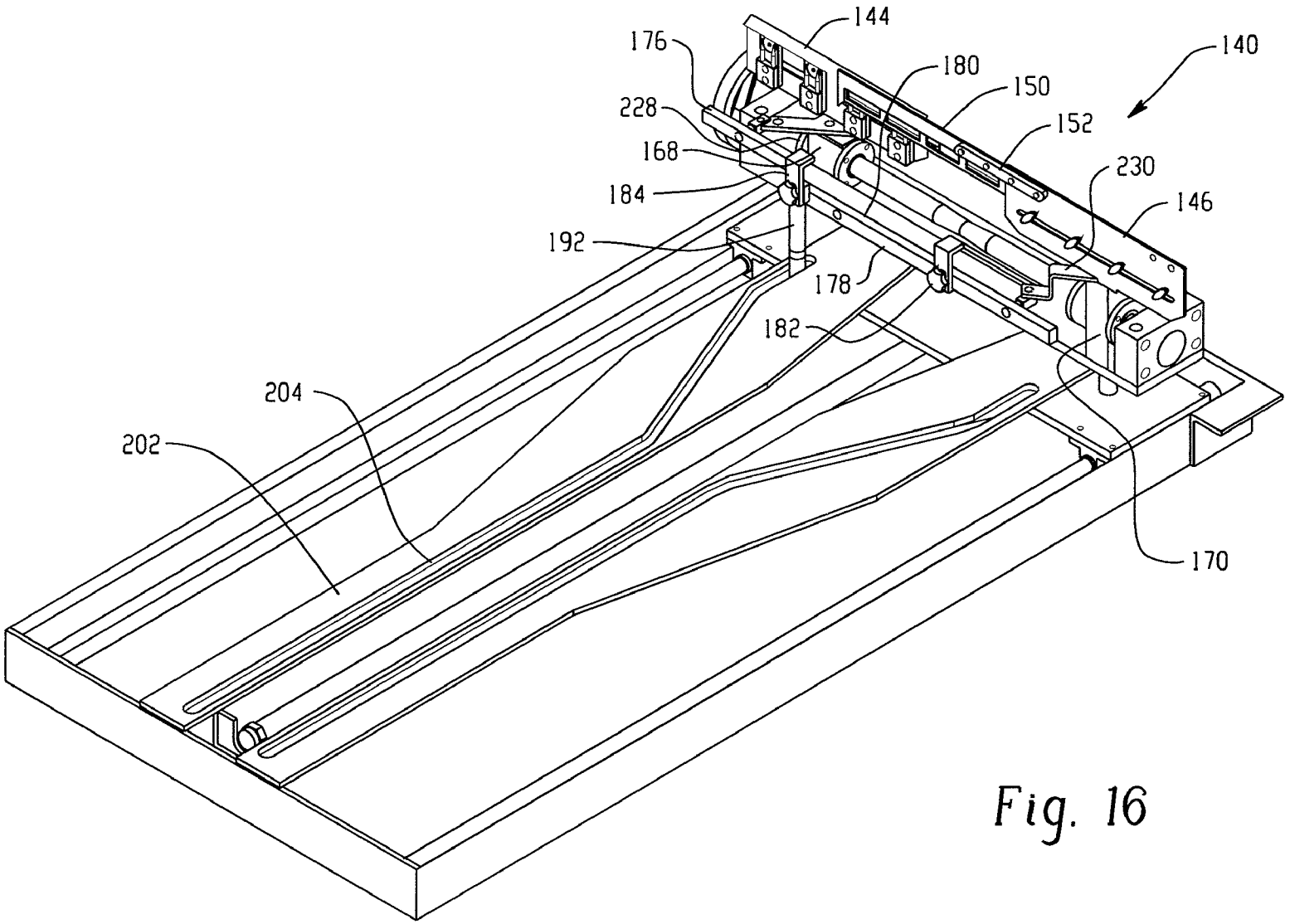
FIGS. 16-18 illustrate a left hand configuration of the case erector device of FIG. 6 to handle left hand open style cases.

As noted above, in some embodiments, the case erector and sealer apparatus 100 can be converted from a right hand opening apparatus for handling right hand open style cases (see, e.g., FIGS. 11-15) to a left hand opening apparatus for handling left hand open style cases. Referring particularly to FIG. 16 and also to FIG. 8, to convert the case erector and sealer apparatus 140 from a right hand opening apparatus as shown in FIG. 8 to a left hand opening apparatus as shown by FIG. 16, the follower assembly 176 is disconnected from the linkages 172 and 174. The moveable arms 144 and 146 may then be rotated about 180 degrees such that alternative linkages 228 and 230 (see FIG. 9) are presented to the follower assembly 176. The follower assembly 176 is rotated 180 degrees and the follower pin 192 and brackets 182 and 184 are repositioned as shown by FIG. 16. The alternative linkages 228 and 230 are pivotally connected to the rods 178 and 180 as shown. In some embodiments, the extended support member 150 connected to each moveable arm 144 and 146 by the connecting member 152 is moved from one end of the respective moveable arm to the opposite end of the respective arm.

Figure 17:
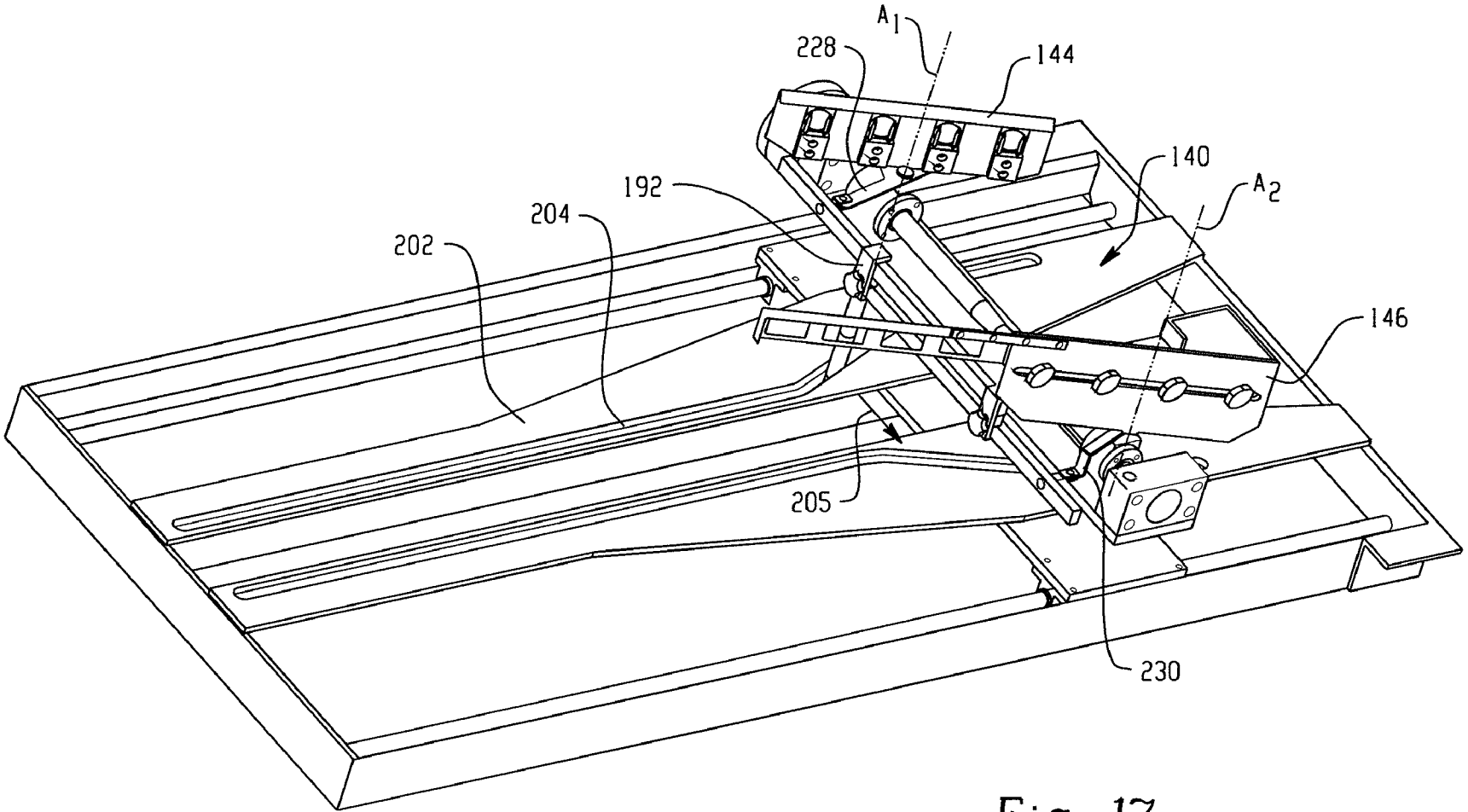
Figure 18:
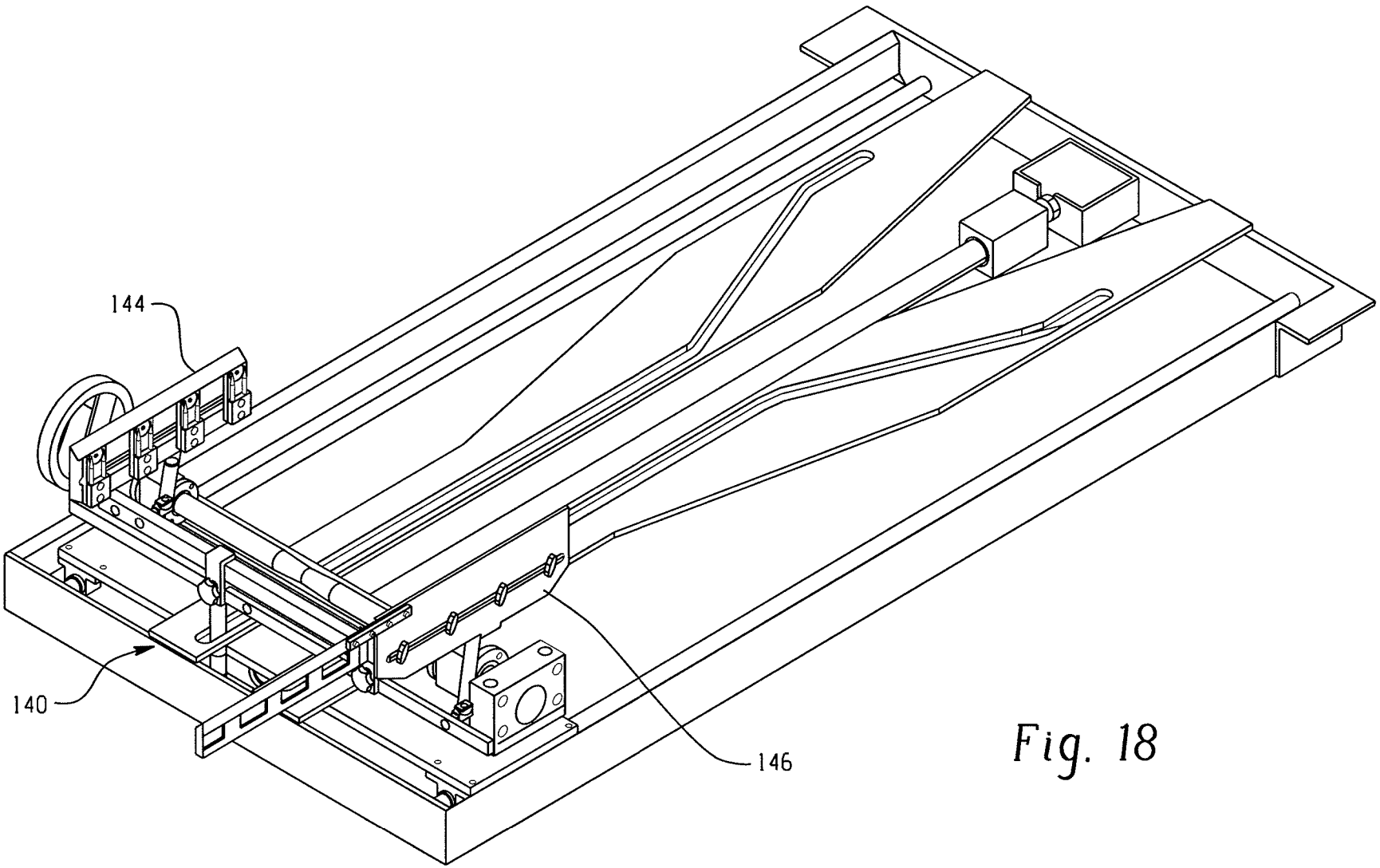

Referring also to FIGS. 17 and 18, the case erector device 140 is moved linearly in the conveying direction along guide rods with the follower pin 192 located in the cam track 204 of the adjacent plate 202. As an alternative, plate 196 may be flipped over on its opposite side and placed where plate 202 is shown to provide the cam track 204. The moveable arms 144 and 146 are shown initially parallel to each other and extending in the cross-conveying direction. As the case erector device 140 moves, the follower pin 192 moves in the cross-conveying direction relative to the mount frame 142 and the mounting blocks 168 and 170 due to the shape of the cam track 194. This movement of the follower pin 192 results in corresponding movement of the follower assembly 176 in the direction of arrow 205 which, in turn, results in movement of the linkages 228 and 230 and their moveable arms 144 and 146 about their respective pivot axes $A_1$ and $A_2$ in a sense opposite that described above with reference to FIGS. 8-10 to handle the left hand open style cases. FIG. 18 illustrates the moveable arms 144 and 146 in their fully rotated configurations where they are parallel to each other and extend in the conveying direction.

In some embodiments, various features described above are adjustable to accommodate cases of various sizes. For example, referring back to FIG. 3, handles 232 and 234 are provided to manually adjust the height of the case blank positioning device 216 to accommodate cases of various heights and to manually adjust the height and/or width of the case blank feeder 102 according to width and height of the bottom flaps. In some embodiments, the sloped feed members 116 and 118 are linked to maintain a center line between the sloped feed members as their distance from each other is adjusted. Additionally, the distance between the side conveyors 212 and 214 may also be adjusted to accommodate cases of various widths and the side conveyors may also be linked to maintain a center line between the side conveyors (e.g., aligned with the bottom tape head) as their distance from each other is adjusted.

FIGS. 19-22 illustrate another embodiment of a case erector device 240. The case erector device 240 includes a conveying mount frame 242 that carries a first moveable arm 244 and a second moveable arm 246. Each moveable arm 244 and 246 includes one or more, in this instance, four and three gripping devices 248 for gripping a bottom flap (e.g., see flaps 38, 40, 42, 44 of FIG. 1) of the case blank. Moveable arm 244 includes an extended support member 250 connected thereto by a connecting member 252. In the illustrated embodiment, the gripping devices 248 are pin and dome combinations (also labeled element number 248), which are mounted on a vertical face 254 of the respective moveable arms 244 and 246. As above, other gripping devices can be used, such as pins only with no dome. The pin and dome combinations 248 are used to grip opposite bottom flaps of the case blank in a fashion similar to that described above.

Figure 20:
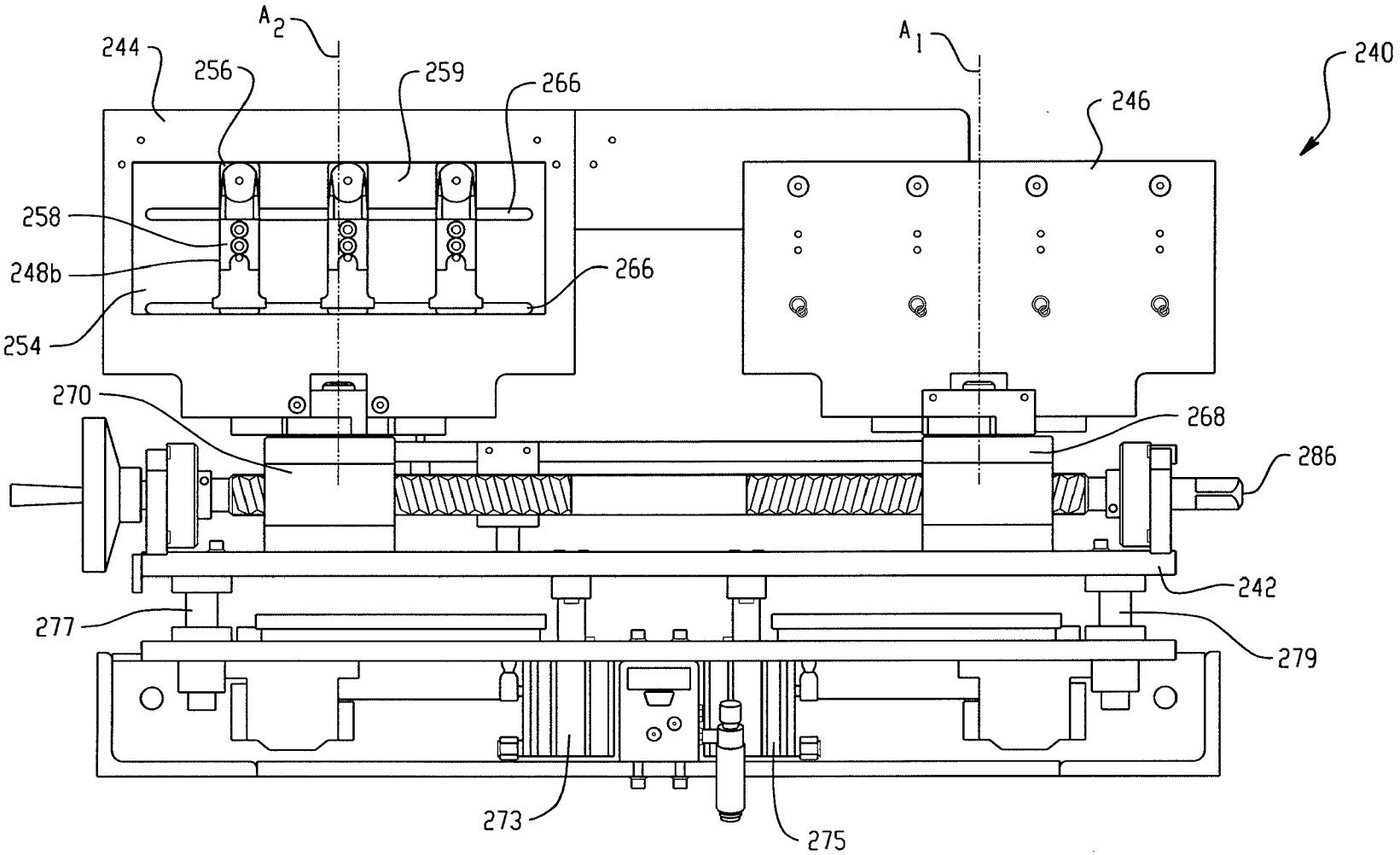
Figure 21:
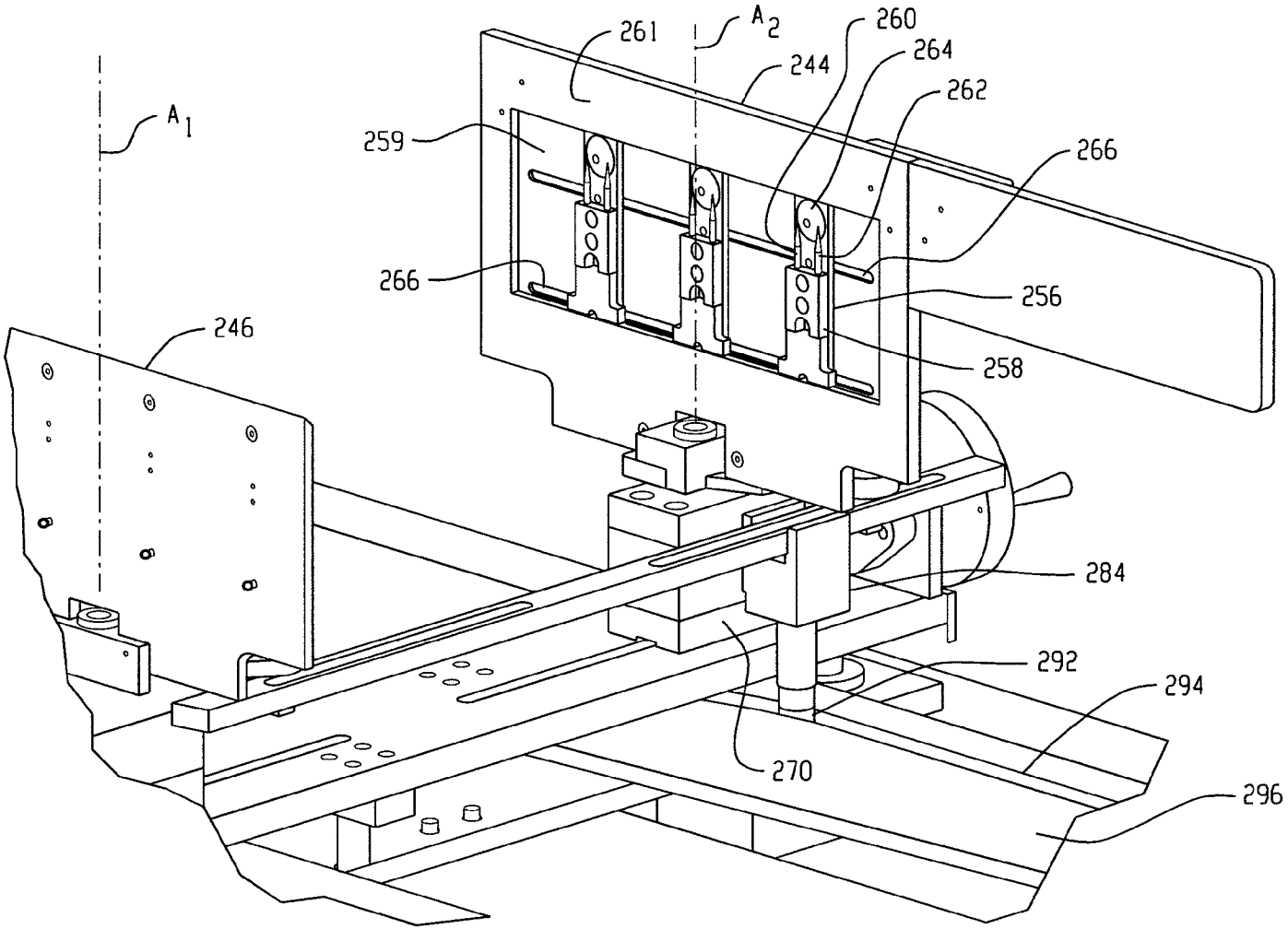

In contrast to the pin and dome combinations 148 described above and referring particularly to FIG. 19, pin and dome combinations 248*a* do not include a panel or block 156 that is mounted to the associated face 254. Instead, the pin and dome combinations 248*a* include a mounting block 258 and dome 264 that are mounted directly to the face 254 of the moveable arm 246 by fasteners. This pin and dome arrangement 248*a* removes the panel 156 so that it does not interfere with gripping of the bottom panels of the case blank. Referring particularly to FIGS. 20 and 21, pin and dome combinations 248*b* include panels or blocks 256 that are mounted to the face 254 of the moveable arm 244 by a fastener 257, in this case a thumb screw or alternatively a flat head screw fastener. The mounting block 258 is mounted to the lower end of the panel 256. The panels 256 are located within a recessed area 259 of the moveable arm 244 so that the panels 256 do not interfere with gripping of the bottom panels of the case blank. For example, in one embodiment, the area 259 is recessed from surface 261 a distance that is equal to about the thickness of the panels 256.

Referring to FIGS. 19-22, as above, each mounting block 258 is provided with at least one passage, in this implementation, two substantially parallel passages through which holding pins 260 and 262 pass. As can be seen, the holding pins 260 and 262 are pointed vertically upward toward the dome 264. The holding pins 260, 262 and dome 264 are located relative to each other such that a laminate layer 58, 60 (FIG. 1A) of the laminate material forming the case blank can be gripped therebetween.

In the embodiment shown, the positions of only the pin and dome combinations 248*b* are adjustable by loosening the thumb screw 257 and moving the pin and dome combinations along the lengths of their respective moveable arm 244 within a lengthwise slot 266. This allows for adjustment of the distance between adjacent pin and dome combinations 248*b* to accommodate cases of various dimensions. Pin and dome combinations 248*a* are fixed relative to each other along the length of moveable arm 246.

Figure 19:
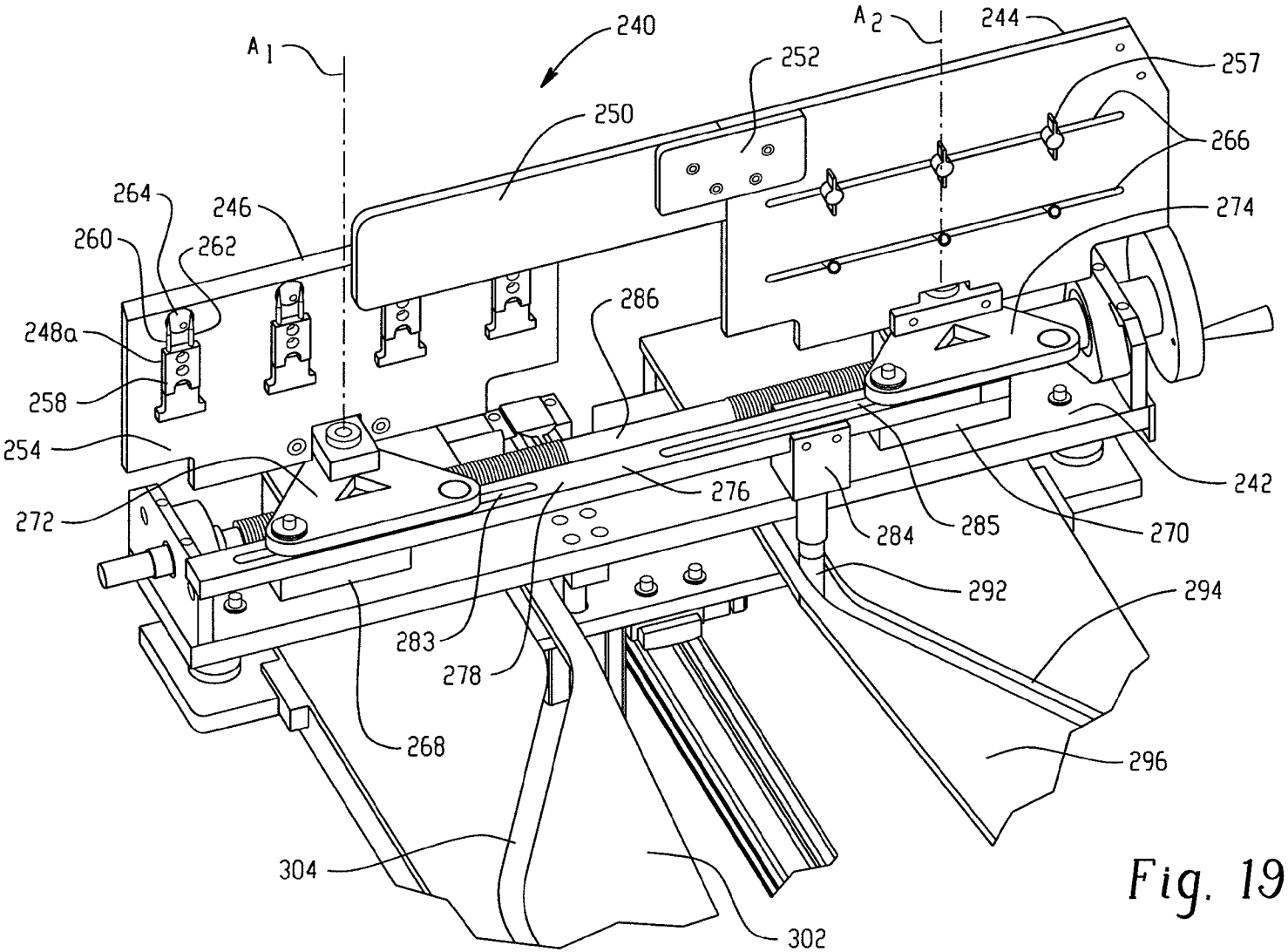
FIGS. 19-22 illustrate another embodiment of a case erector device.
Figure 22:
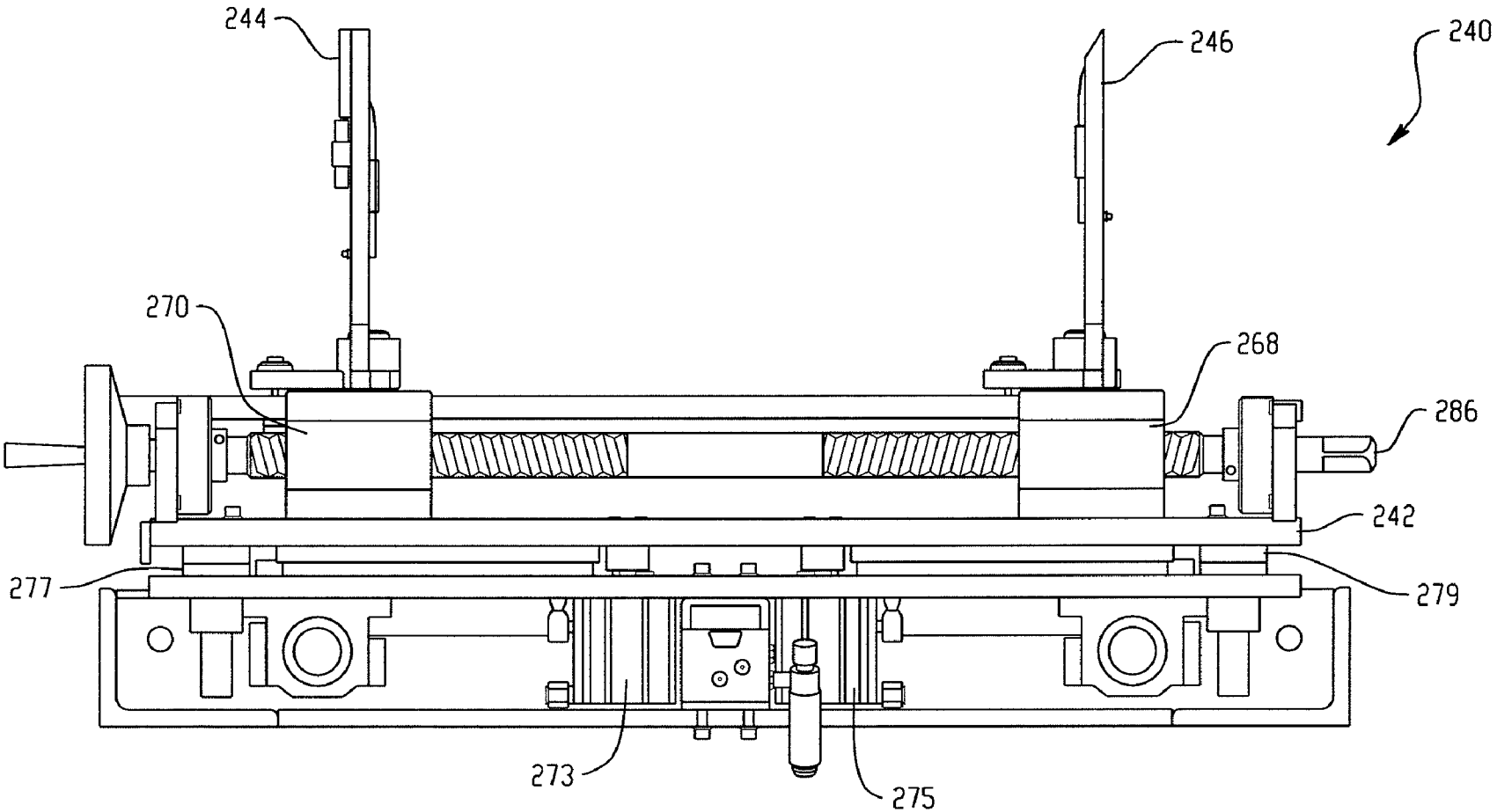

Referring to FIGS. 19, 21 and 22, the first and second moveable arms 244 and 246 are pivotally mounted at respective axes $A_1$ and $A_2$ to a respective mounting block 268 and 270 by respective linkages 272 and 274. The linkages 272 and 274 are each connected to a follower assembly 276 of the case erector device 240 that moves along with the conveying mount frame 242. In this embodiment, the follower assembly 276 includes only a single rod 278 (as opposed to the overlapping rods 178 and 180 described above) where linkages 272 and 274 are both connected to rod 278. The linkages 272 and 274 are rotatably connected to the rod 278 within slots 283 and 285.

An adjustment member 286 allows for adjustment of a distance between the moveable arms 244 and 246 in a fashion similar to that described above with respect to adjustment member 186. The connection between the linkages 272, 274 and the rod 278 can be adjusted along the length of the slots 283 and 285.

A follower pin 292 extends downwardly from a bracket 284 and is received within a cam track 294 formed in plate 296. The shape of the cam track 294 causes the follower assembly 276 to move linearly in a cross-conveying direction as the case erector device 240 is moved in the conveying direction. Movement of the follower assembly 276, in turn, causes movement of the linkages 272 and 274 and their moveable arms 244 and 246 about their respective pivot axes $A_1$ and $A_2$. As can be seen, adjacent plate 302 includes another cam track 304 that is a mirror of cam track 294 and can be used in changing a configuration of the case erector device 240 from a left hand opening configuration as shown to a right hand opening configuration, which is described below.

As noted above with respect to moveable arms 144 and 146, the moveable arms 244 and 246 may also move up and down. Referring to FIG. 20, actuators 273 and 275 (e.g., pneumatic cylinders) may be used to move the moveable arms 244 and 246 vertically. This vertical movement may be employed to remove the gripping members 248 from the bottom flaps of the case blank before a folding operation, such as a folding operation similar to that described above. Guide members 277 and 279 may be used to prevent horizontal movement of the moveable arms 244 and 246. FIG. 20 shows the moveable arms 244 and 246 in their normal, fully raised position when gripping case blanks and FIG. 22 shows the moveable arms 244 and 246 in their lowered, fully retracted position when releasing case blanks prior to a folding operation.

Figure 23:
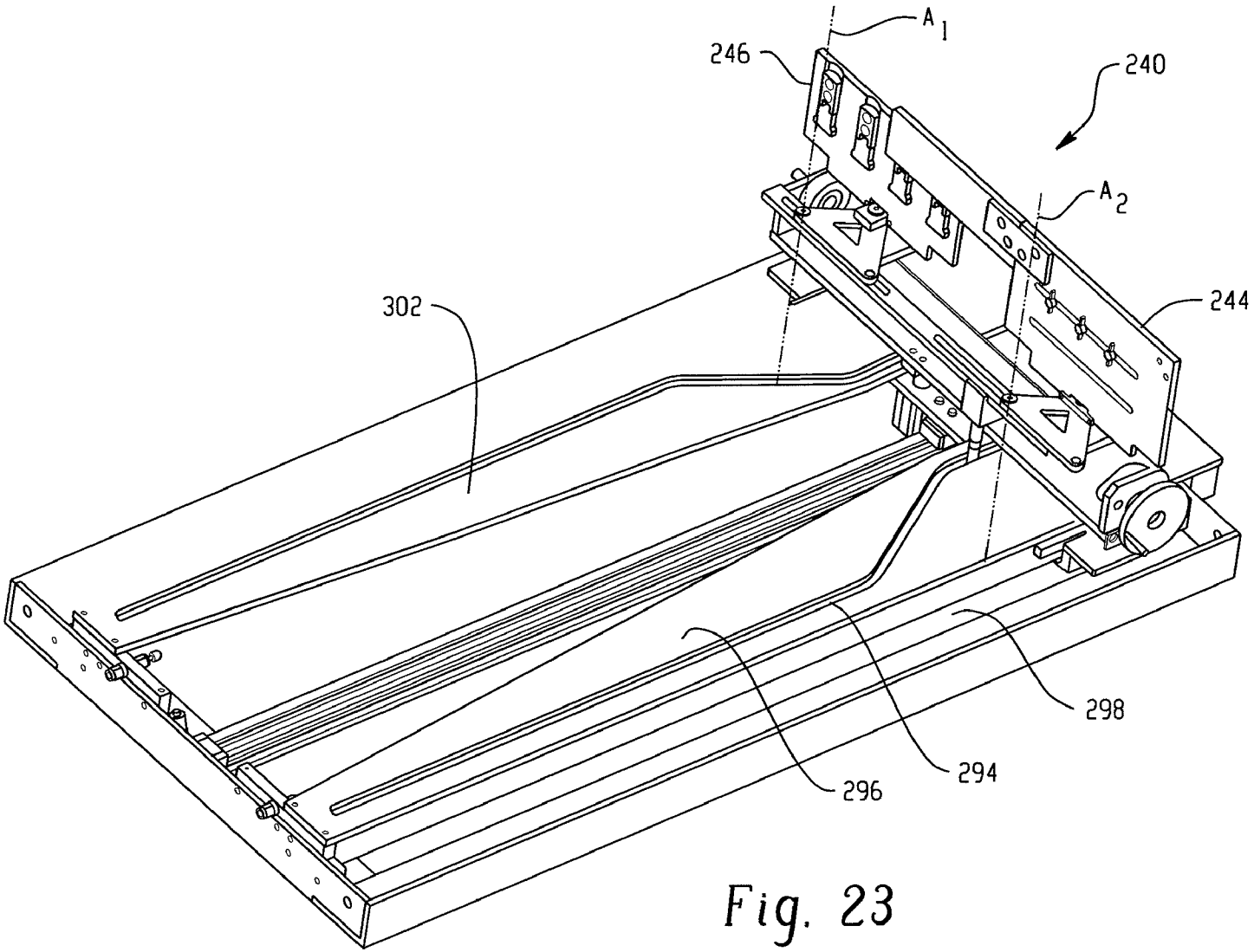
FIGS. 23-25 illustrate operation of the case erector device of FIG. 19 in a left hand configuration to handle left hand open style cases.
Figure 24:
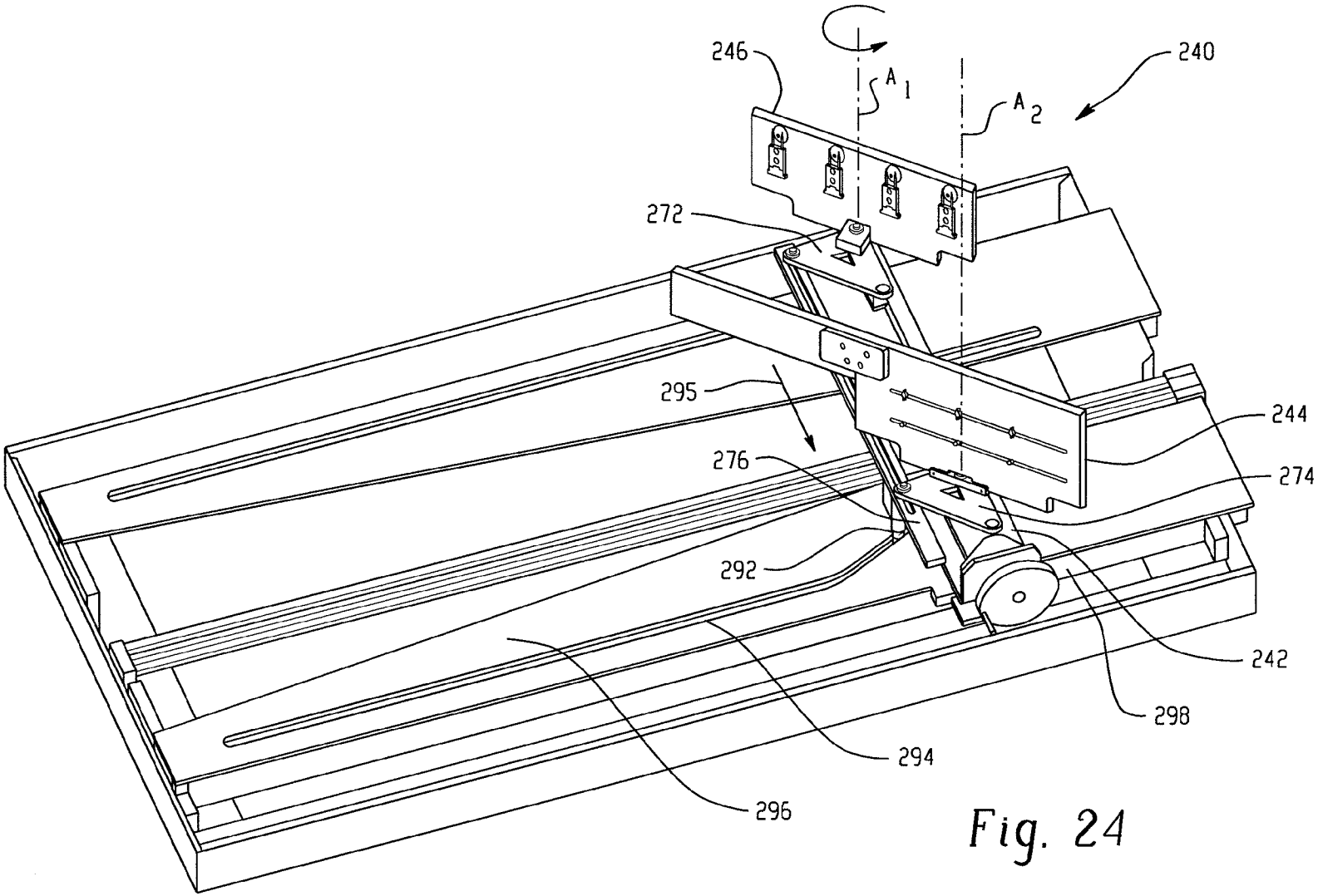
Figure 25:
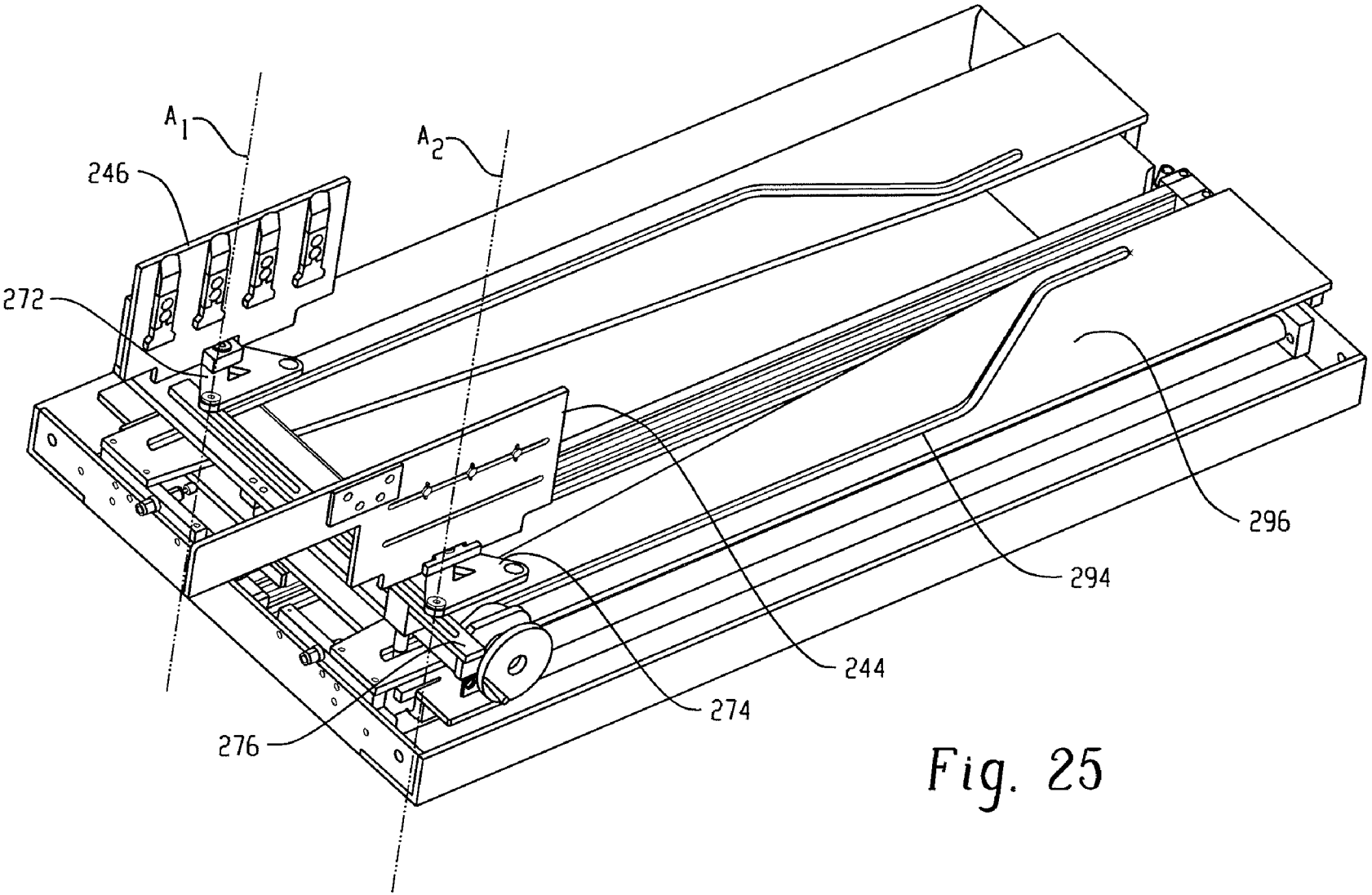

FIGS. 23-25 illustrate operation of the case erector device 240 as it is moved in the conveying direction through the apparatus 100 with the case erector device and the plates 296 and 302 shown in isolation. Referring first to FIG. 23, the case erector device 240 is moved linearly in the conveying direction along guide rods 298 in a fashion similar to that described above. The moveable arms 244 and 246 are initially parallel to each other and extend in the cross-conveying direction. Referring to FIG. 24, as the case erector device 240 moves in the conveying direction toward the bottom fold and seal station, the follower pin 292 moves in the cross-conveying direction (in the direction of arrow 295) relative to the mount frame 242 due to the shape of the cam track 294. This movement of the follower pin 292 results in corresponding movement of the follower assembly 276 which, in turn, results in movement of the linkages 272 and 274 and their moveable arms 244 and 246 about their respective pivot axes $A_1$ and $A_2$. FIG. 25 illustrates the moveable arms 244 and 246 in their fully rotated configurations where they are parallel to each other and extend in the conveying direction.

Figure 26:
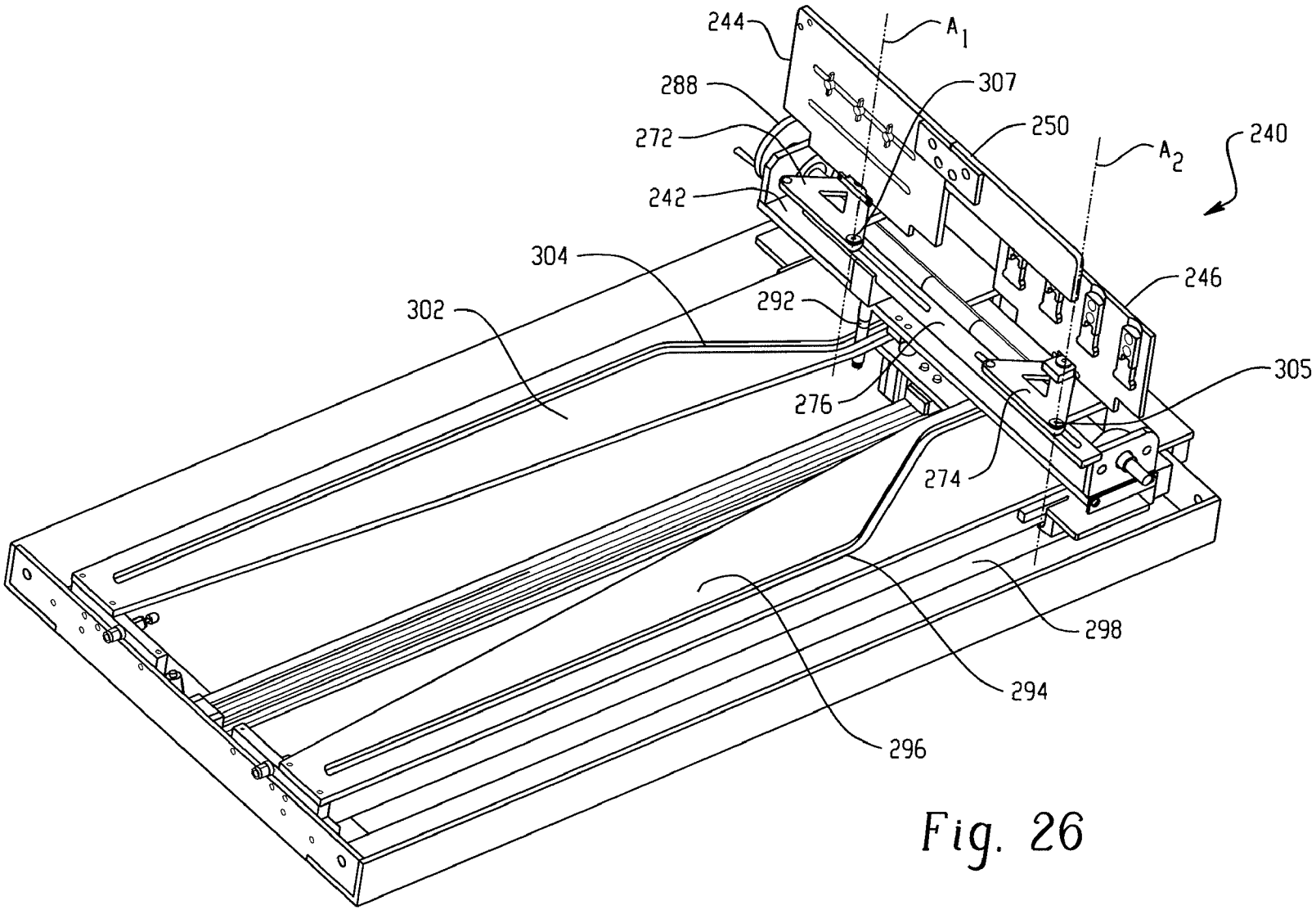
FIGS. 26-29 illustrate a right hand open configuration of the case erector device of FIG. 19 to handle right hand open style cases.

As noted above, the case erector device 240 can be converted from left hand opening for handling left hand open style cases to right hand opening for handling right hand open style cases. Referring particularly to FIG. 26, to convert the case erector and sealer apparatus 240 from a left hand opening apparatus as shown in FIG. 23 to a right hand opening apparatus as shown by FIG. 26, the follower assembly 276 is disconnected from the linkages 272 and 274. The positions of moveable arms 244 and 246 may then be exchanged and the linkages 272 and 274 reconnected to the rod 278 at alternative connecting locations 305 and 307. In some embodiments, the follower assembly 276 is rotated 180 degrees. The follower pin 292 is repositioned as shown by FIG. 26. In some embodiments, the extended support member 250 connected to moveable arm 244 by the connecting member 252 is moved from one end of the respective moveable arm to the opposite end of the respective arm.

Figure 27:
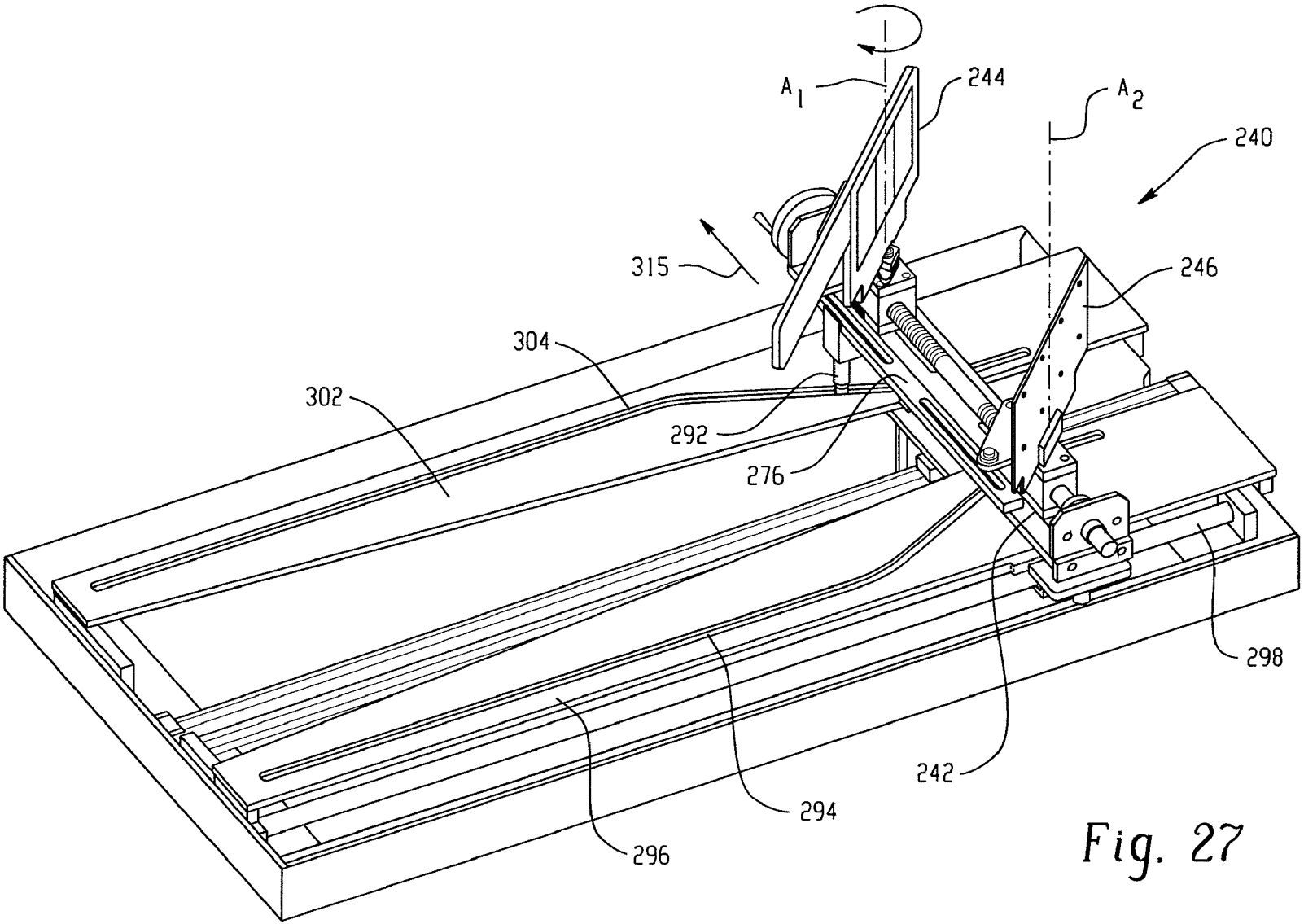
Figure 28:
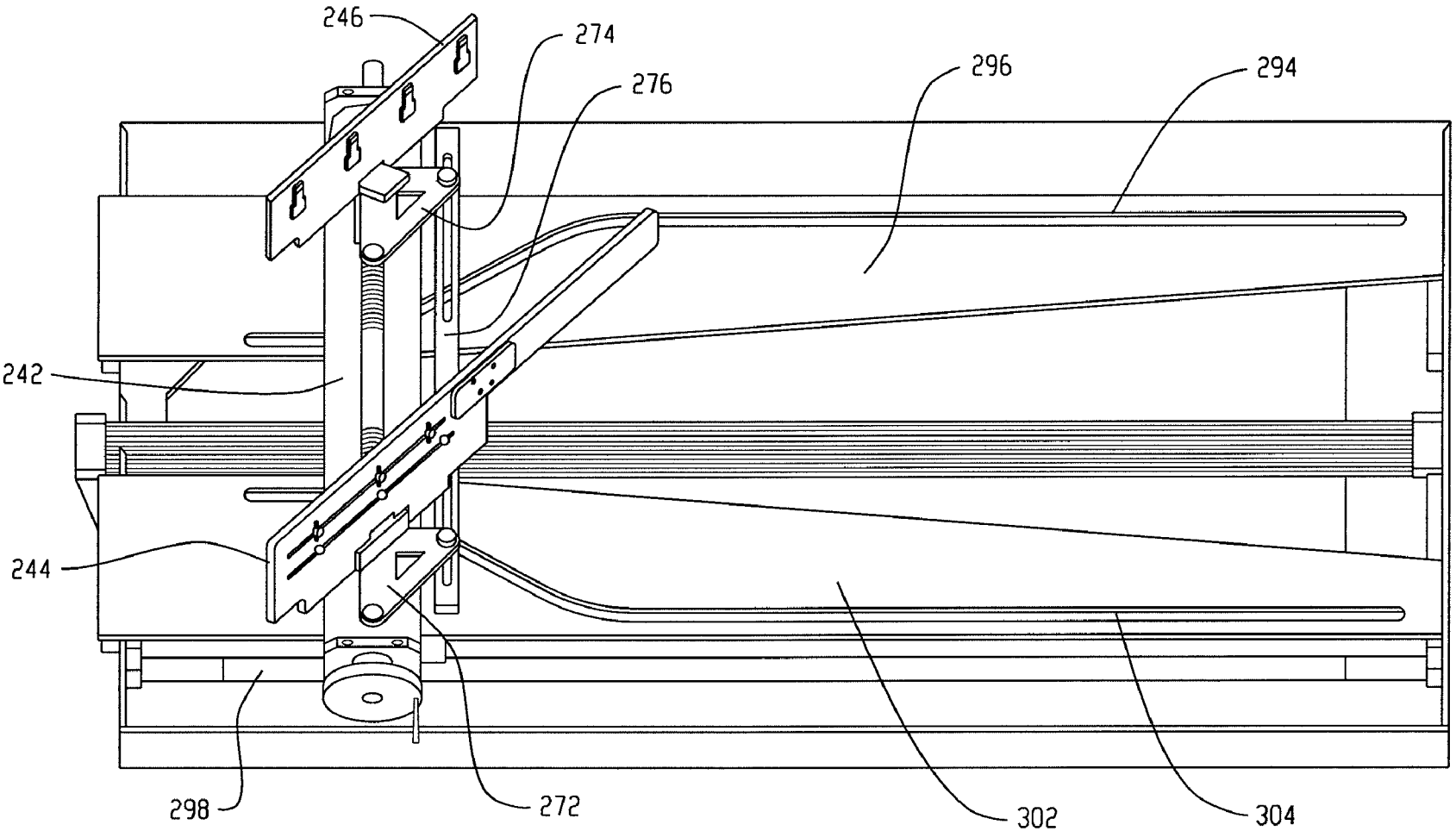
Figure 29:
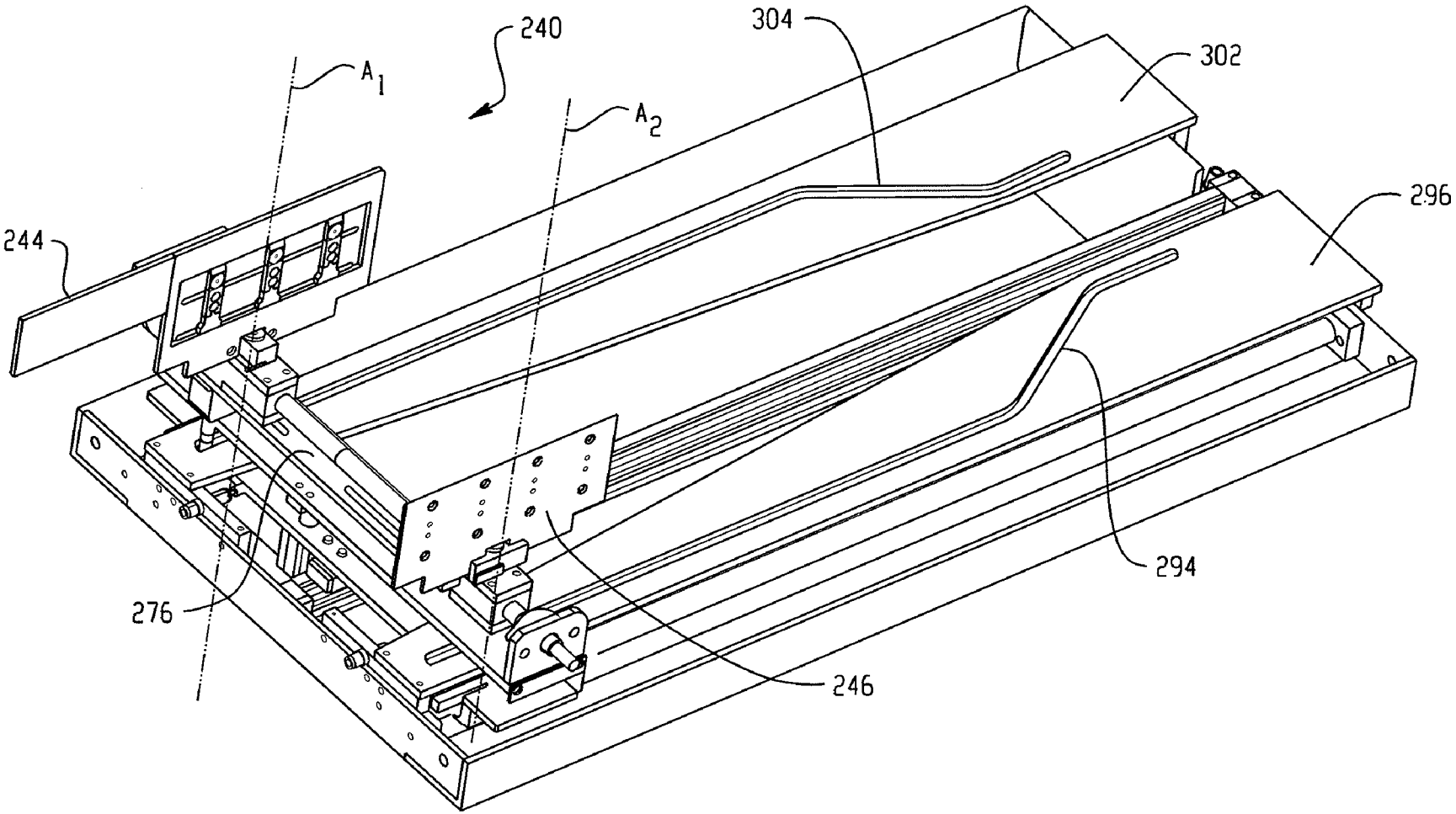

Referring also to FIGS. 27 and 28, the case erector device 240 is moved linearly in the conveying direction along guide rods with the follower pin 292 located in the cam track 304 of the adjacent plate 302. The moveable arms 244 and 246 are shown initially parallel to each other and extending in the cross-conveying direction. As the case erector device 240 moves, the follower pin 292 moves in the cross-conveying direction (in the direction of arrow 315) relative to the mount frame 242 due to the shape of the cam track 304. This movement of the follower pin 292 results in corresponding movement of the follower assembly 276 in the direction of arrow 309 which, in turn, results in movement of the linkages 272 and 274 and their moveable arms 244 and 246 about their respective pivot axes $A_1$ and $A_2$ in a sense opposite that described above with reference to FIGS. 23-25 to handle the left hand open style cases. FIG. 29 illustrates the moveable arms 244 and 246 in their fully rotated configurations where they are parallel to each other and extend in the conveying direction.

Advantageously, the moveable arms with their associated gripping elements can be used to grip opposite bottom flaps of the case blank, which can provide increased stability for the case blank as it is being erected, for example, as compared to gripping adjacent flaps of the case blank at one corner. Additionally, the moveable arms and of the case erector device grip the case blank at the bottom flaps from the bottom of the case blank, which can provide for increased stability while erecting the cases (e.g., compared to gripping the case blanks at their top) particularly in instances involves cases having a high height to width and/or height to length ratio. Furthermore, gripping the case blanks at their bottoms may facilitate filling of the erected cases at an earlier stage once their bottom flaps are folded as there are less overhead mechanisms that can interfere will a filling operation, thereby reducing guarding that may be used on the machine.

Figure 30:
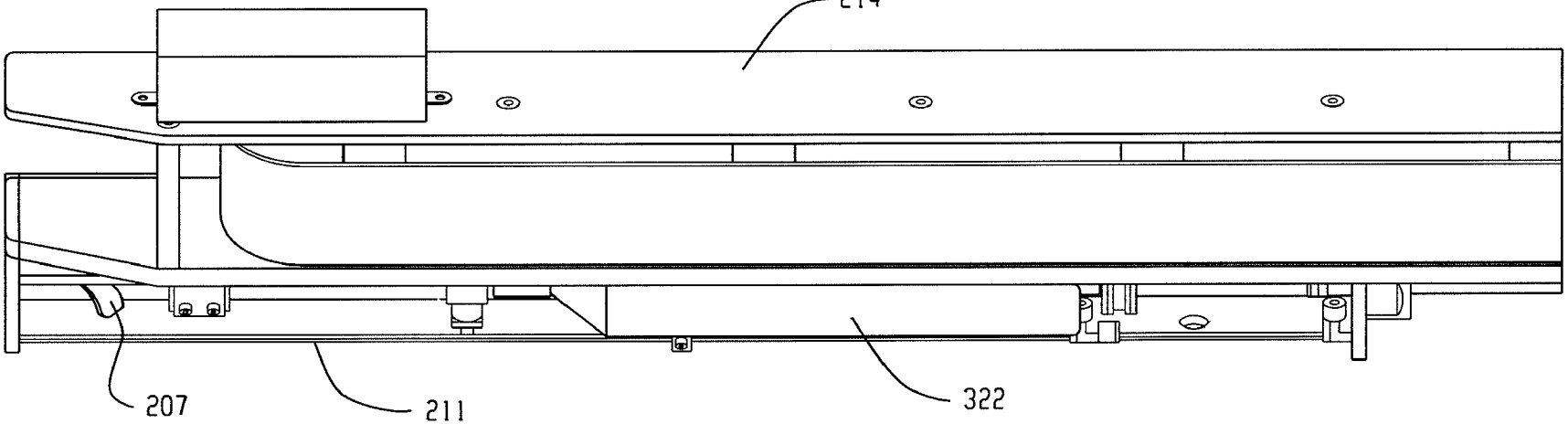
FIGS. 30-35 illustrate details of an embodiment of a flap folding portion of the case erector and sealer apparatus of FIG. 3.
Figure 31:
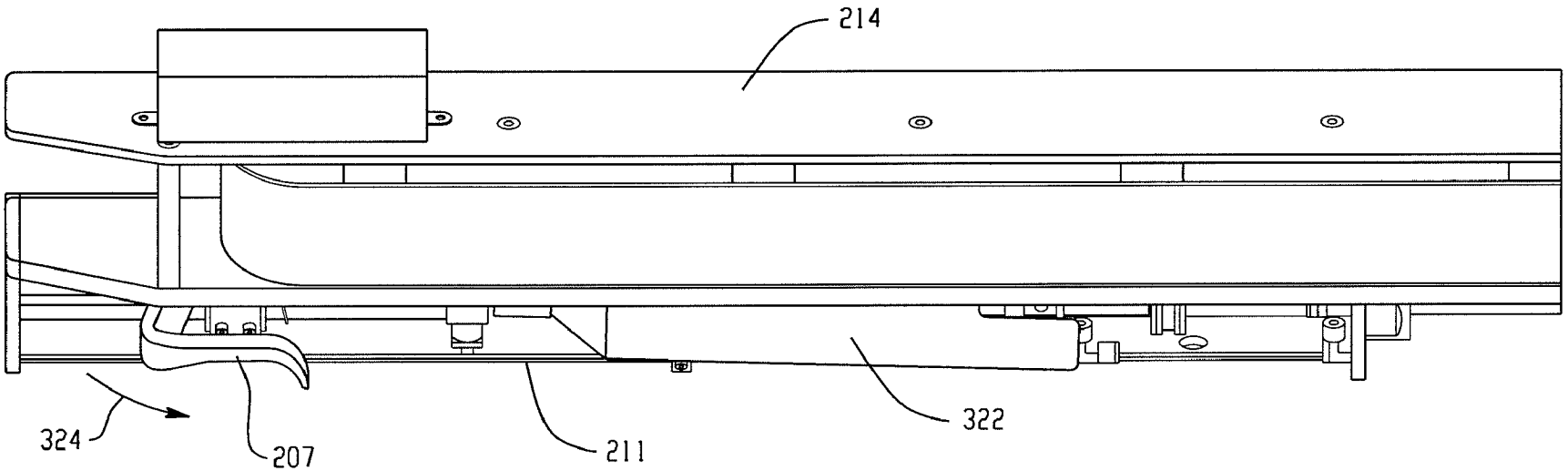
Figure 32:
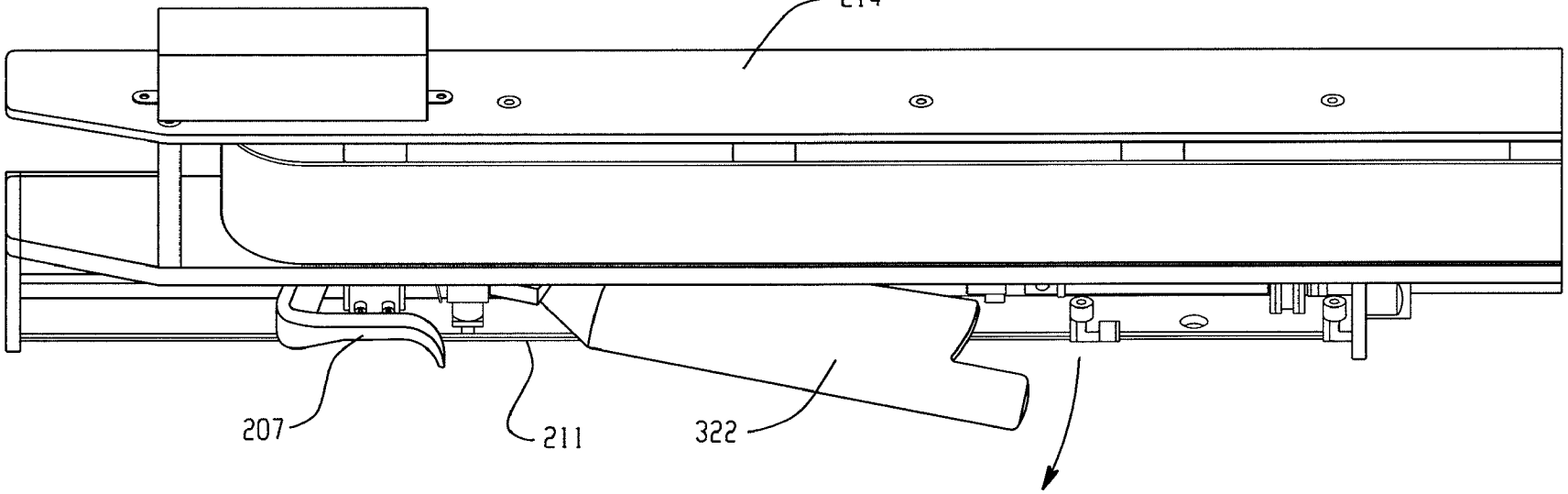

FIGS. 30-35 illustrate, in greater detail, the operation of the bottom flap folders of the flap folding portion 106 (see FIG. 3) that act from the underside of each side belt conveyor 212 and 214 to fold both the rear minor case flap and the side major case flaps. Referring to FIG. 30, the machine left-hand folder 211 is mounted under conveyor 214 and is shown in its home position with minor flap folder arm 207 and major flap folder arm 322 retracted. There is a matching mirror image folder 209 mounted under the opposite conveyor 212 (not shown). In this home position, the folders 211 and 209 are in position to receive an erected case blank between them as delivered by the case erecting device 140 (or 240). After the case blank is in position, FIG. 31 shows the first stage of the folder action with the minor flap folder arm 207 rotated out or extended as shown by direction arrow 324. With this motion, the folder arm 207 together with the opposite side folder arm (not shown) make contact with and fold up the rear minor flap as the case blank is held stationary with the major side flaps engaged on the movable arms 144 and 146 (or 244 and 246) of the erector device 140 (or 240). After the moveable arms 144 and 146 (or 244 and 246) are lowered (as shown in FIG. 22) and the pins are withdrawn from the side major flaps, the second stage of the folder action extends the major flap folder arm 322 as shown in FIG. 32. The major folder arm 322 together with the opposite side folder arm (not shown) make contact with and fold up the case left-hand and right-hand side major flaps. The conveyors 212 and 214 then move the case over fixed flap guide 213 and, in some embodiments, flap guides 208 and 210 (as shown in FIG. 4) and the case sealing portion 108.

Figure 33:
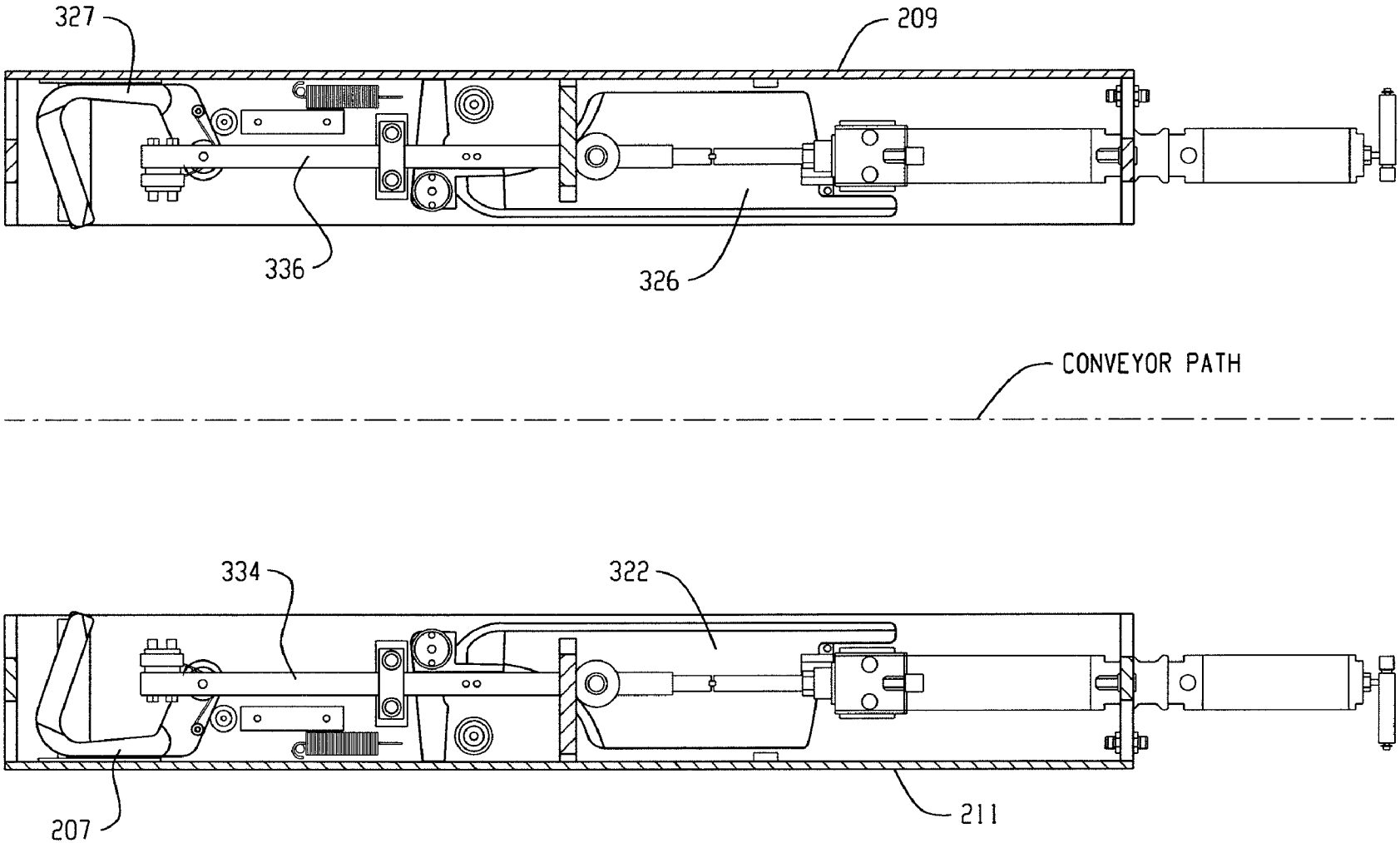
Figure 34:
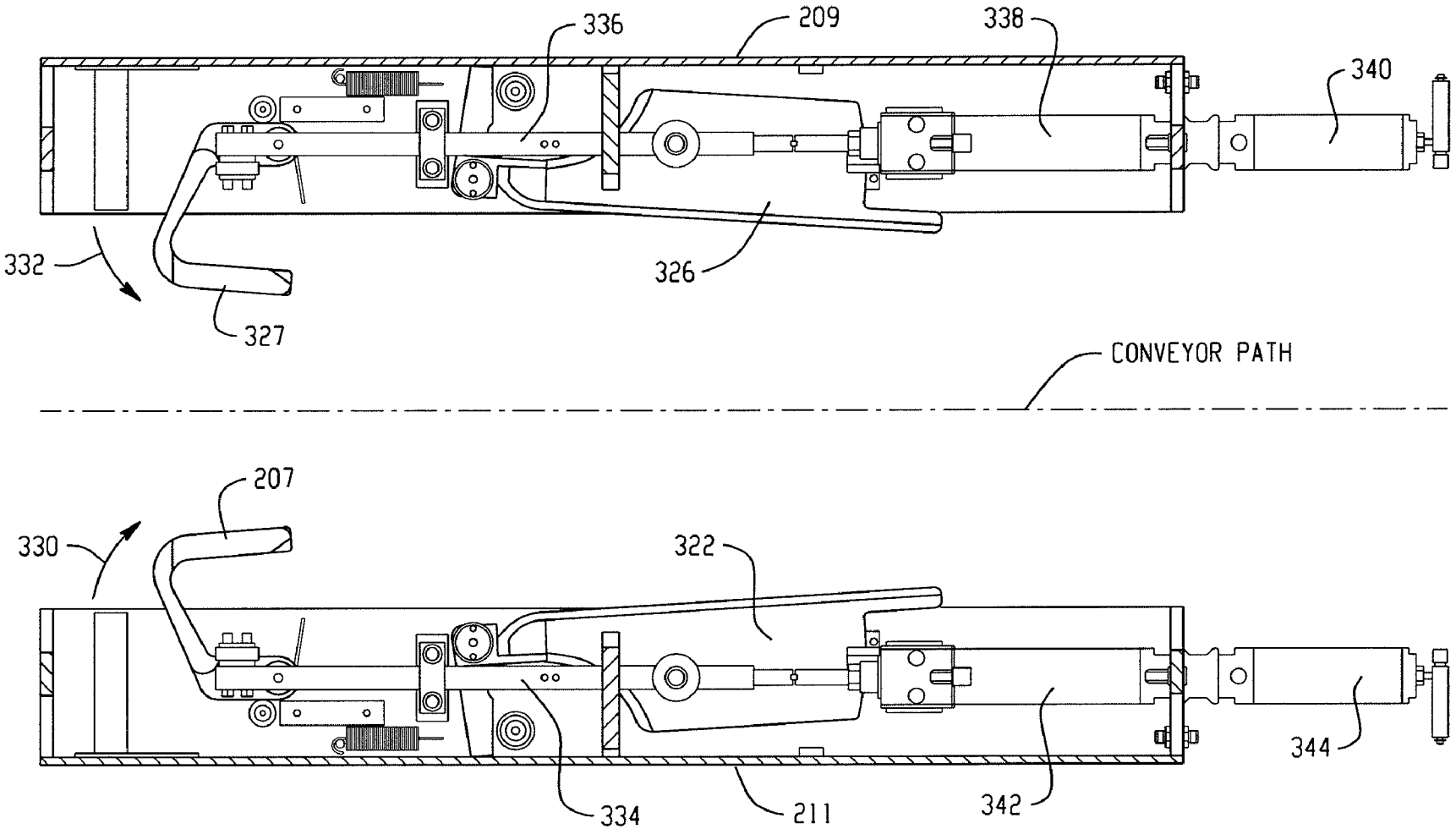
Figure 35:
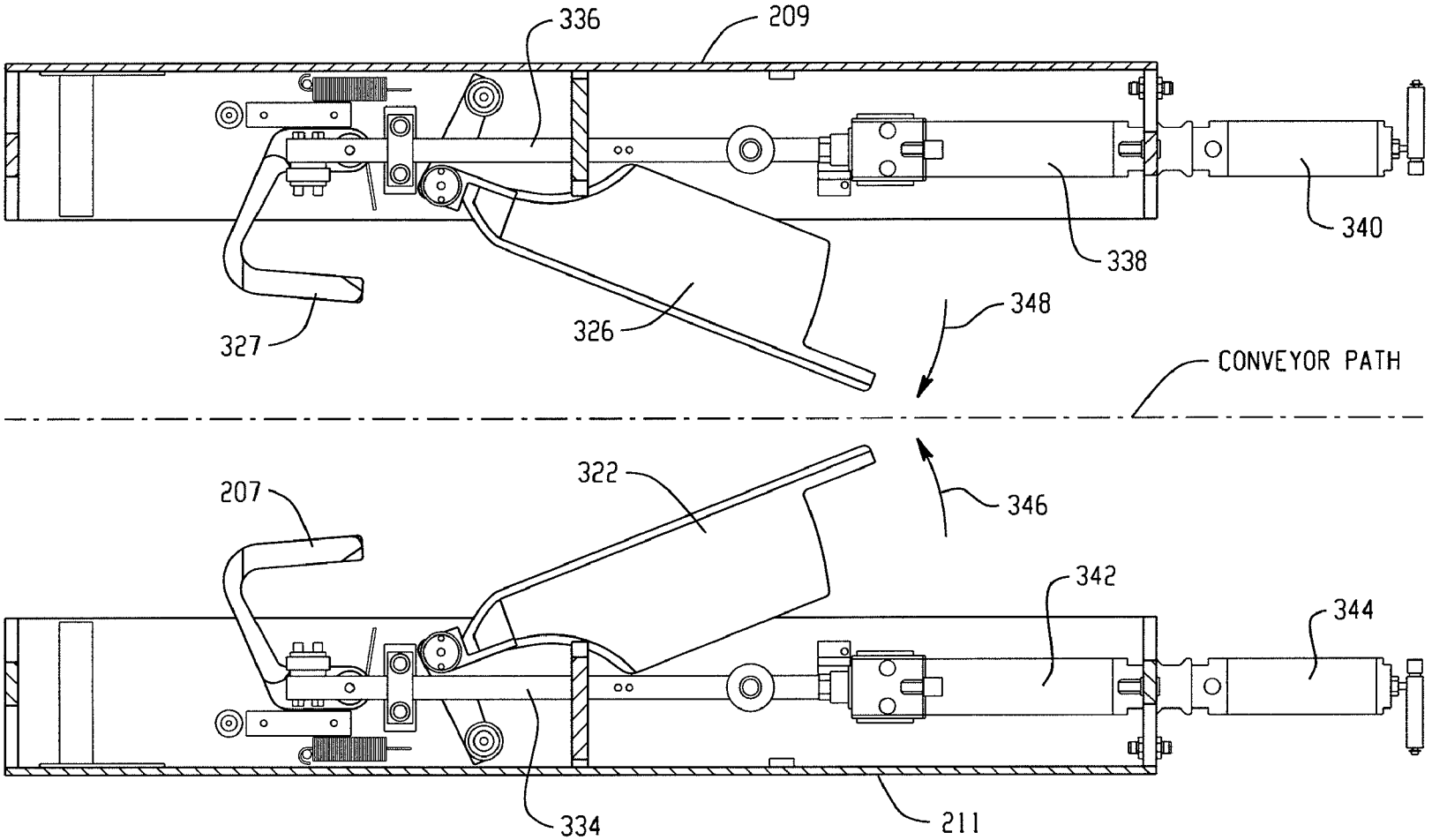

FIGS. 33-35 are a sectioned views from underneath (looking up) showing the mechanisms of the left-hand folder 211 and right-hand folder 209. FIG. 33 shows both folders in their home position minor flap folders 207 and 327 and major flap folders 322 and 326 retracted. FIG. 34 shows the first stage of the folder action with the minor flap folder arms 207 and 327 rotated out or extended as shown by direction arrows 330 and 332. The minor folder arms 207 and 327 are hingedly connected to the bars 334 and 336 which in turn are connected to separate or multi-stage cylinders, in this embodiment dual-stage cylinders 338 and 340 in folder 209 and 342 and 344 in folder 211. The first stage action of the cylinders causes them to retract and move the bars 334 and 336 to the right as shown just enough to cause the minor folder arms 207 and 327 to rotate out. FIG. 35 shows the second stage of the folder movement where the second stage action of the cylinders 338 and 340 in folder 209 and 342 and 344 in folder 211 moves the bars 334 and 336 further to the right, causing cam follower rollers attached to the bars to act against the curved cam surface of major flap folder arms 322 and 326 such that they rotate out into an extended position as shown by direction arrows 346 and 348. Reversing the direction of the cylinders moves the bars 334 and 336 to the left as shown and both the major folder arms 322 and 326 and the minor folder arms 207 and 327 return to their home positions by spring action.

It is to be clearly understood that the above description is intended by way of illustration and example only and is not intended to be taken by way of limitation, and that changes and modifications are possible. For example, servos may be used to move various components of the case erector and sealer apparatus 100 as opposed to pneumatic cylinders. Additionally, the tape head mechanism may, in some implementations, be replaced with a different adhesive-applying apparatus, such as a glue apparatus. In some embodiments, the moveable arms are arranged to grip adjacent bottom flaps of the case blank, for example, in a clamshell-like fashion as opposed to opposite bottom flaps. Accordingly, other embodiments are within the scope of the following claims.

What is claimed is:

1. An automated case erecting apparatus for use in erecting case blanks, the apparatus comprising:

a case blank feeder configured to hold a plurality of upstanding case blanks arranged face-to-face, the case blank feeder including a path along which the case blanks are directed; and a case erecting assembly that receives a case blank from the case blank feeder at a case receiving location, the case erecting assembly including a first arm carrying a first gripper element and a second arm carrying a second gripper element, the first arm and associated first gripper element arranged and configured such that the first gripper element grips a first flap of the case blank, the second arm and associated second gripper element arranged and configured such that the second gripper element grips a second flap of the case blank, the case erecting assembly configured to move in a conveying direction from the case receiving location toward a case bottom fold and seal station to carry the gripped case blank toward the case bottom fold and seal station, wherein the first gripper element comprises a plurality of upwardly extending pin assemblies arranged on the first arm, and the second gripper element comprises a plurality of upwardly extending pin assemblies arranged on the second arm, and wherein the case erecting assembly is positioned below the end of the path of the case blank feeder when in the case receiving location, the first flap is a bottom flap and the second flap is a bottom flap, free ends of pins of the pin assemblies of the first arm and second arm point upward to engage bottom edges of the first and second flaps.

2. The apparatus of claim 1 wherein the case blank is erected while the case erecting assembly moves toward the case bottom fold and seal station via pivoting of at least one of the first and second arms pivots from a case blank receiving orientation to a case blank erecting orientation.

3. The apparatus of claim 2 wherein both the first arm and the second arm pivot from respective case blank receiving orientations to respective case erecting orientations as the case erecting assembly carries the gripped case blank in the conveying direction, the first flap is opposite the second flap.

4. The apparatus of claim 3 wherein the case erecting assembly includes a first orientation to handle right hand open style cases wherein a follower assembly including a downwardly extending follower pin such that as the case erecting assembly moves along the conveying direction, the follower pin moves within an elongate first cam track, interaction of the follower pin and the first cam track causes the first and second arms to pivot in a first direction.

5. The apparatus of claim 4 wherein the case erecting assembly includes a second orientation to handle left hand open style cases wherein the follower pin is positioned to move within an elongate second cam track that is spaced from the first cam track, interaction of the follower pin and the second cam track causes the first and second arms to pivot in a second direction.

6. The apparatus of claim 1 wherein the first and second arms of the case erecting assembly are movable vertically, the case bottom fold and seal station includes opposed side conveyors, the case erecting assembly carries the gripped case blank to the case bottom fold and seal station and, upon transfer of the erected case blank to the side conveyors, the first and second arms of the case erecting assembly are moved vertically away from the erected case blank.

7. The apparatus of claim 6 wherein the case erecting assembly moves back toward the case receiving location as the transferred case blank is moved through the case bottom fold and seal station.

8. An automated case erecting apparatus for use in erecting case blanks, the apparatus comprising:

a case blank feeder configured to hold a plurality of upstanding case blanks arranged face-to-face, the case blank feeder including a path along which the case blanks are directed; and a case erecting assembly that receives a case blank from the case blank feeder at a case receiving location, the case erecting assembly including a first arm carrying a first gripper element and a second arm carrying a second gripper element, the first arm and associated first gripper element arranged and configured such that the first gripper element grips a first case flap of the case blank, the second arm and associated second gripper element arranged and configured such that the second gripper element grips a second case flap of the case blank, where the second case flap is opposite the first case flap, the case erecting assembly configured to erect the case blank by pivoting both the first arm and the second arm from respective case receiving orientations to respective case erecting orientations, wherein the first gripper element comprises a plurality of pin and dome assemblies arranged on the first arm, and the second gripper element comprises a plurality of pin and dome assemblies arranged on the second arm, and wherein the case erecting assembly is positioned below the end of the path of the case blank feeder when in case receiving location and free ends of the pins of the pin and dome assemblies of the first arm and second arm point upward to engage bottom edges of the first and second case flaps.

9. The apparatus of claim 8 wherein each case receiving orientation is substantially perpendicular to a conveying direction from the case feeder to a case bottom fold and seal station, and each case erecting orientation is substantially parallel to the conveying direction.

10. The apparatus of claim 8 wherein the case erecting assembly moves forward as case bottom fold and seal station as the first arm and the second arm are pivoted.

11. The apparatus of claim 8 wherein the case erecting assembly includes an adjustment mechanism for simultaneously adjusting the position of the first arm and the second arm relative to a centerline of case erecting assembly for repositioning the first gripper element and the second gripper element to accommodate various sizes of case blanks.

12. An automated case erecting apparatus for use in erecting case blanks, the apparatus comprising:

a case blank feeder configured to hold a plurality of upstanding case blanks arranged face-to-face, the case blank feeder including a path along which the case blanks are directed; and a case erecting assembly that receives a case blank from the case blank feeder at a case receiving location, the case erecting assembly including a first arm carrying a first gripper element and a second arm carrying a second gripper element, the first arm and associated first gripper element arranged and configured such that the first gripper element includes upwardly extending pins that engage a bottom edge of a first bottom case flap of the case blank, the second arm and associated second gripper element arranged and configured such that the second gripper element includes upwardly extending pins that engage a bottom edge of a second bottom case flap of the case blank, and at least one of the first arm and the second arm moves to erect the case.

13. The apparatus of claim 12 wherein the case erecting assembly is located lower than the path of the case blank feeder.

14. The apparatus of claim 13 wherein the case blank feeder includes a case blank push mechanism that moves the case downward from the path toward the case erecting assembly.

15. The apparatus of claim 13 wherein the path of the case blank feeder is downwardly inclined toward the location of the case erecting assembly.

16. The apparatus of claim 12 wherein the case blank feeder includes a case blank push mechanism that moves the case downward from the path and into engagement with the free ends of the pins.

17. An automated case erecting apparatus for use in erecting case blanks, the apparatus comprising:

a case blank feeder configured to hold a plurality of upstanding case blanks arranged face-to-face, the case blank feeder including a path along which the case blanks are directed; and a case erecting assembly that receives a case blank from the case blank feeder at a case receiving location, the case erecting assembly including a first arm including a first plurality of pin and dome assemblies mounted thereon and a second arm including a second plurality of pin and dome assemblies mounted thereon, a multiplicity of the pin and dome assemblies of the first arm mounted for movement and selective positioning along a lengthwise slot of the first arm, a multiplicity of the pin and dome assemblies of the second arm mounted for movement and selective positioning along a lengthwise slot of the second arm.

18. The apparatus of claim 17 wherein:

each pin and dome assembly of the multiplicity on the first arm includes a block structure to one side of the first arm, an adjustment post extending through the lengthwise slot of the first arm, and a grip head on the adjustment post, and each pin and dome assembly of the multiplicity on the second arm includes a block structure to one side of the second arm, an adjustment post extending through the lengthwise slot of the second arm, and a grip head on the adjustment post.

* * * * *